US005657860A

United States Patent [19]

Koike et al.

[11] Patent Number: 5,657,860

[45] Date of Patent: Aug. 19, 1997

[54] KEYSWITCH HAVING A REDUCED HEIGHT AND A KEYBOARD USING SUCH A KEYSWITCH

[75] Inventors: Tamotsu Koike; Syuji Nakamura; Jun-ichi Maruyama; Norio Endo, all of Tokyo, Japan

[73] Assignee: Fujitsu Takamisawa Component Limited, Tokyo, Japan

[21] Appl. No.: 579,800

[22] Filed: Dec. 28, 1995

[30] Foreign Application Priority Data

Aug. 11, 1995 [JP] Japan ..... 7-206265
Nov. 10, 1995 [JP] Japan ..... 7-292585

[51] Int. Cl.[6] ..... H01H 13/70

[52] U.S. Cl. ..... 200/344; 200/341

[58] Field of Search ..... 200/344, 345, 200/341, 520, 512, 517, 5 A

[56] References Cited

U.S. PATENT DOCUMENTS

| | | | |
|---|---|---|---|
| 4,902,862 | 2/1990 | Oelsch et al. | 200/344 |
| 5,268,545 | 12/1993 | Brunn | 200/344 |
| 5,329,084 | 7/1994 | Watanabe et al. | 260/344 |
| 5,457,297 | 10/1995 | Chen | 200/344 |

*Primary Examiner*—David J. Walczak
*Attorney, Agent, or Firm*—Staas & Halsey

[57] ABSTRACT

A keyswitch includes a keytop, a base, an elastic actuator between the keytop and the base, a switch actuated by the actuator, and a link mechanism disposed between the base and the keytop, the link mechanism including first and second link members engaged with each other mechanically at respective first ends thereof, wherein the first and second link members further establish a slide engagement with a rear surface of the keytop at respective second ends thereof.

16 Claims, 20 Drawing Sheets

20B

KEYSWITCH HAVING A REDUCED HEIGHT AND A KEYBOARD USING SUCH A KEYSWITCH

BACKGROUND OF THE INVENTION

The present invention generally relates to keyswitches as well as keyboards using keyswitches, and more particularly to a low height keyswitch for use in keyboards of compact, portable computers.

FIGS. 1A and 1B show a conventional keyswitch 10 used in laptop computers and palm-top computers respectively in a state before actuation and after actuation.

Referring to FIGS. 1A and 1B, the keyswitch 10 is provided on a support panel 14 that in turn carries thereon a key housing 15, wherein the keyswitch 10 includes a keytop 11 adapted for being actuated by the finger of an operator. The keytop 11 further includes a cylindrical sleeve guide 11*a* accepted in a corresponding sleeve guide 15*a* provided on the key housing 15, and the keytop 11 is guided along the sleeve guide 15*a* of the key housing 15 as it is actuated by the finger of operator as a result of engagement of the cylindrical sleeve guide 11*a* and the corresponding sleeve guide 15*a*. Further, the keyswitch 10 includes a membrane 13 at a bottom part thereof in intimate engagement with the support panel 14, wherein the membrane 13 includes therein a membrane switch 12, and the keytop 11 engages with the membrane via a deformable, elastic actuator 16.

Thus, upon actuation of the keytop 11 as indicated in FIG. 1B by a finger 19 of the operator, the keytop 11 is pressed down while being guided by the sleeve guide 15*a* of the housing 15 in a direction $Z_2$ (FIG. 1A), and the elastic actuator 16 collapses as indicated in FIG. 1B. In response to such a deformation of the actuator 16, the membrane switch 12 is closed. Upon release of the keytop 11, on the other hand, the elastic actuator 16 resiliently restores the original state, and the keytop 11 is pushed upward in a direction $Z_1$ while being guided also by the sleeve guide 15*a*. Thereby, the membrane switch 12 returns to an open state.

Such a conventional keyswitch 10, while having an advantageous feature of simple construction, has a problem in that the overall height of the keyswitch 10, designated by $H_1$ in FIG 1A, cannot be reduced satisfactorily. It should be noted that the height $H_1$ is given as a sum of a height $H_2$ of a top surface 15*b* of the key housing 15 as measured from a bottom surface of the support panel 14, a height $H_3$ of the sleeve guide 15*a* as measured from the top surface 15*b* of the key housing 15, a height $H_4$ corresponding to the stroke of the keyswitch, and a thickness $t_1$ of a keytop face plate 11*b*.

Generally, the sleeve guide 15*a* has to have a height of at least 3–4 mm in order to hold the keytop 11 stably. Thus, it is necessary to secure a height of 3–4 mm for the height $H_3$. Because of this, it has been necessary to secure a height of about 11 mm for the overall height $H_1$ of the keyswitch 10, while such an overall height $H_1$ is too large for the keyboards for use in laptop computers and palm-top computers. In relation to above, it should be noted that a keytop of a keyswitch is generally required to have a press down stroke S (FIG. 1B) of about 3 mm in order for the operator to confirm the action of pressing down of the keytop based upon the sense of the finger. This means that one has to secure a height of at least about 3 mm for the height $H_4$ in the keyswitch 10.

The conventional key switch of FIGS. 1A and 1B has another drawback in that the key switch is vulnerable to dust.

In order to guarantee a smooth pressing down of the keytop 11 even when the finger of the operator has missed the center of the keytop 11, the sleeve guides 11*a* and 15*a* are engaged to form a very small gap 17 therebetween. Thus, when a fine dust particle has entered such a small gap 17, the movement of the sleeve guide 11*a* in the axial direction as indicated by arrows $Z_1$ and $Z_2$ is resisted substantially. For example, there may occur a case in which the keytop 11 may not return to the original state after being pressed down in the direction $Z_2$, even when the operator has released the keytop 11.

SUMMARY OF THE INVENTION

Accordingly, it is a general object of the present invention to provide a novel and useful keyswitch as well as a keyboard using such a keyswitch, wherein the foregoing problems are eliminated.

Another and more specific object of the present invention is t provide a keyswitch having a reduced height, as well as to provide a keyboard using such a keyswitch of reduced height.

Another object of the present invention is to provide a keyswitch having a guide mechanism of a keytop, wherein the guide mechanism has a reduced height.

Another object of the present invention is to provide a keyswitch, comprising:

a keytop having a keytop surface adapted for being pressed down and a rear surface;

a base disposed below said keytop;

an actuator disposed said keytop and said base, said actuator deforming elastically upon pressing down of said keytop, said actuator thereby exerting a force pushing said keytop upward upon an elastic deformation thereof;

a switch disposed so as to be actuated by said actuator, said switch changing a state thereof upon a deformation of said actuator, between a first, opened state and a second, closed state;

a link mechanism disposed between said base and said keytop, said link mechanism including first and second link members each having a first end slidably engaging said rear surface of said keytop and a second, opposite end pivoted movably to said base at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in opposite directions about said first and second pivot axes;

said rear surface of said keytop forming a guide surface for guiding therealong said first end of said first and second link members.

Another object of the present invention is to provide a keyswitch, comprising:

a keytop having a keytop surface adapted for being pressed down;

a base disposed below said keytop;

an actuator disposed between said keytop and said base, said actuator deforming elastically upon pressing down of said keytop, said actuator thereby exerting a force that pushes said keytop upward upon an elastic deformation thereof;

a switch disposed so as to be actuated by said actuator, said switch changing a state thereof upon deformation of said actuator between a first, opened state and a second, closed state;

a link mechanism disposed between said base and said keytop, said link mechanism including first and second link members each having a first end slidably engaging with a principal surface of said base and a second, opposite end pivoted to said keytop at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in mutually opposite directions about said first and second pivot axes;

said principal surface of said base forming a guide surface for guiding therealong said first end of said first and second link members.

Another object of the present invention is to provide a keyboard comprising a plurality of keyswitches, each of said keyswitches comprising:

a keytop having a keytop surface adapted for being pressed down and a rear surface;

a base disposed below said keytop;

an actuator disposed said keytop and said base, said actuator deforming elastically upon pressing down of said keytop, said actuator thereby exerting a force pushing said keytop upward upon an elastic deformation thereof;

a switch disposed so as to be actuated by said actuator, said switch changing a state thereof upon a deformation of said actuator, between a first, opened state and a second, closed state;

a link mechanism disposed between said base and said keytop, said link mechanism including first and second link members each having a first end slidably engaging said rear surface of said keytop and a second, opposite end pivoted movably to said base at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in opposite directions about said first and second pivot axes;

said rear surface of said keytop forming a guide surface for guiding therealong said first end of said first and second link members.

Another object of the present invention is to provide a keyboard, comprising a plurality of keyswitches, each of said keyswitches comprising:

a keytop having a keytop surface adapted for being pressed down;

a base disposed below said keytop;

an actuator disposed between said keytop and said base, said actuator deforming elastically upon pressing down of said keytop, said actuator thereby exerting a force that pushes said keytop upward upon an elastic deformation thereof;

a switch disposed so as to be actuated by said actuator, said switch changing a state thereof upon deformation of said actuator between a first, opened state and a second, closed state;

a link mechanism disposed between said base and said keytop, said link mechanism including first and second link members each having a first end slidably engaging with a principal surface of said base and a second, opposite end pivoted to said keytop at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in mutually opposite directions about said first and second pivot axes;

said principal surface of said base forming a guide surface for guiding therealong said first end of said first and second link members.

According to the present invention, the height of the keyswitch is reduced substantially by removing the guide sleeves, used conventionally for guiding the keytop vertically with respect to the base, from the rear side of the keytop as well as from the base. In the example of FIG. 1A, the height $H_3$ is reduced by eliminating the guide sleeves. Even when the guide sleeves are thus removed, it should be noted that the stroke S of the keytop movement shown in FIG. 1B is not reduced. Further, a proper guiding of the keytop is achieved by the link mechanism by connecting the first and second link members with each other at the transmission part such that the first and second link members are moved simultaneously in opposite directions with the same amount.

By replacing the guide sleeves with the link mechanism, the problem of dust particles entering the gap between the outer and inner sleeve guides of conventional key switches is successfully eliminated. In the case of the present invention, the area where the link members form a slidable engagement with the keytop rear surface or the principal surface of the base, is substantially reduced. Further, even when the dust particles may enter the gap, the dust particles may escape immediately, as the slide engagement of the,link members is formed in an open environment.

Other objects and further features of the present invention will become apparent from the following detailed description when read in conjunction With the attached drawings.

BRIEF DESCRIPTIONS OF THE DRAWINGS

DETAILED DESCRIPTION OF THE PREFERRED EMBODIMENTS

Figure 2A:
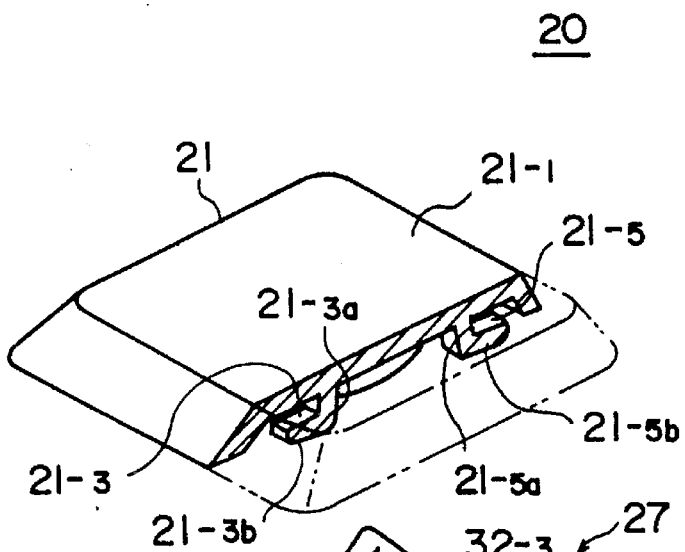
FIGS. 2A–2C are diagrams showing the construction of a keyswitch according to a first embodiment of the present invention in an exploded view.
Figure 2B:
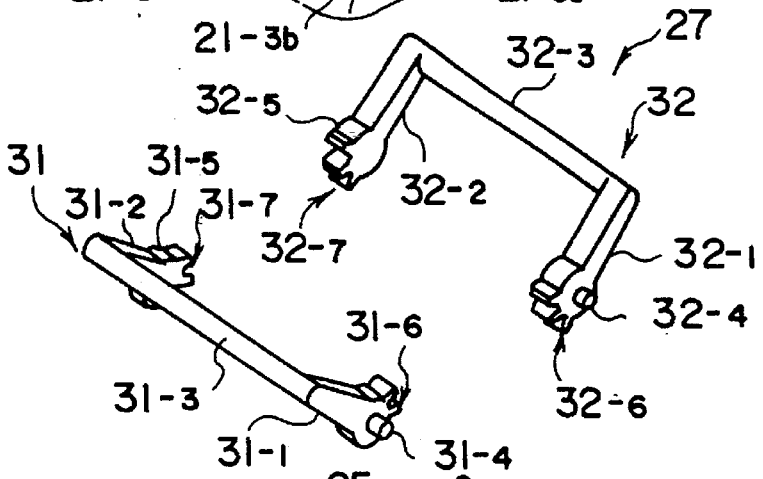
Figure 2C:
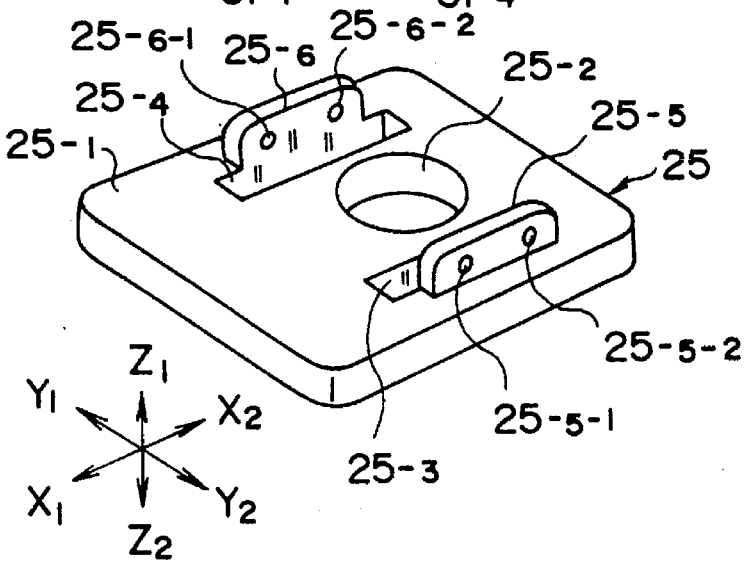
Figure 3:
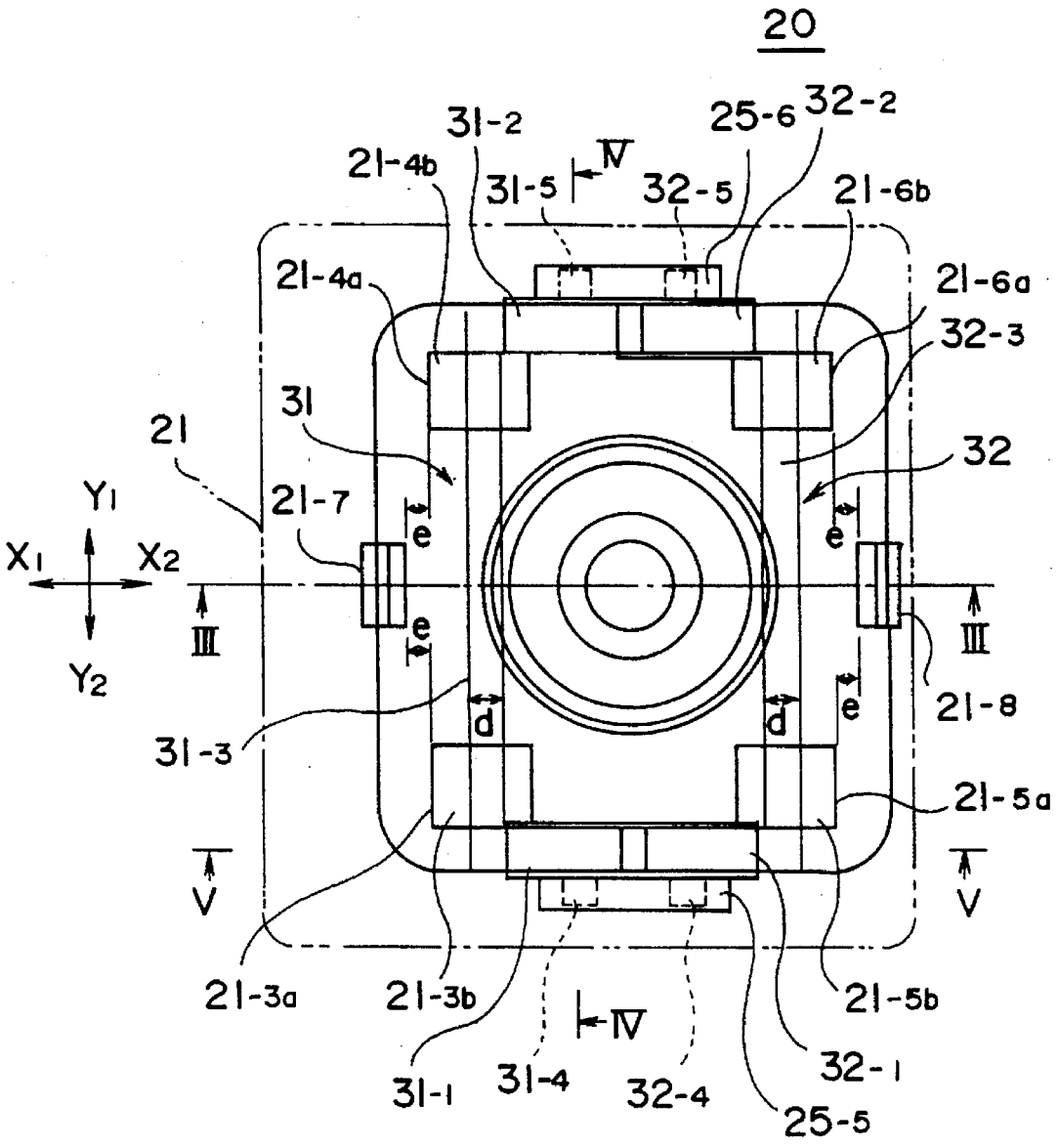
FIG. 3 is a diagram showing the keyswitch of the first embodiment in a plan view.
Figure 4A:
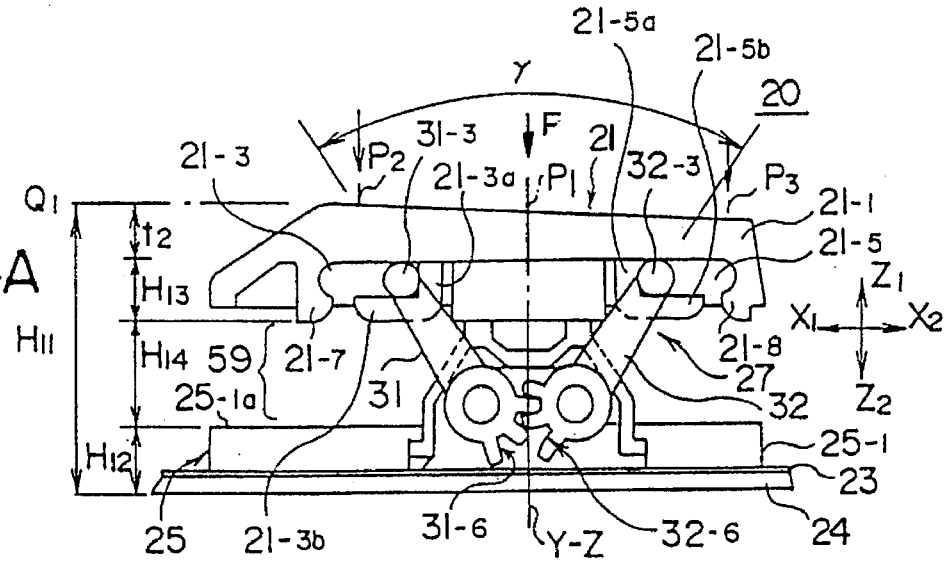
FIGS. 4A–4C are diagrams showing the construction of the keyswitch of the first embodiment in an elevational cross sectional view taken along a line III—III of FIG. 3 for various states thereof.
Figure 4B:
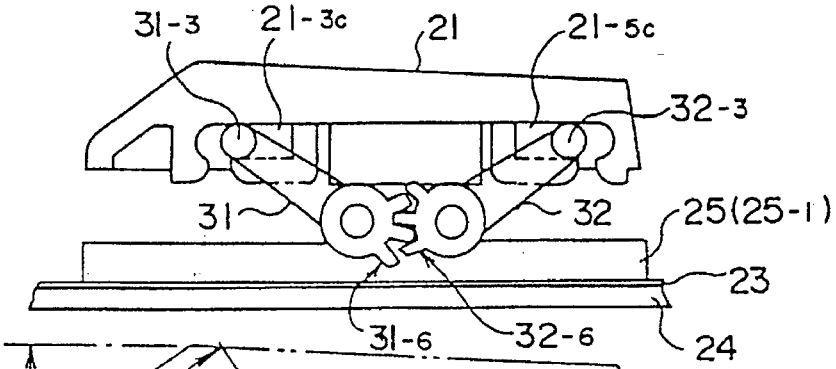
Figure 4C:
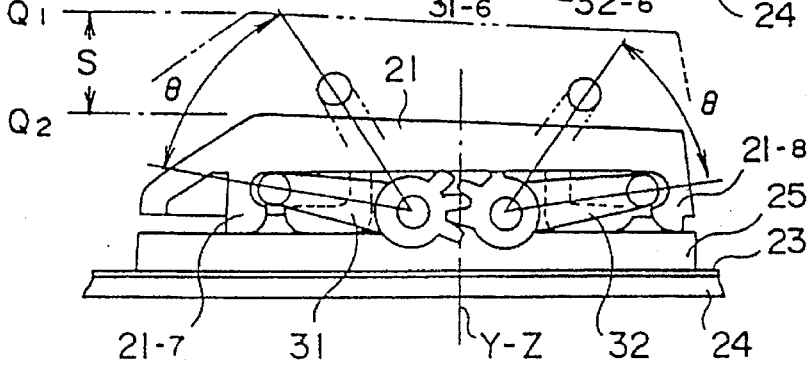
Figure 4C:
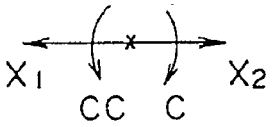
Figure 5A:
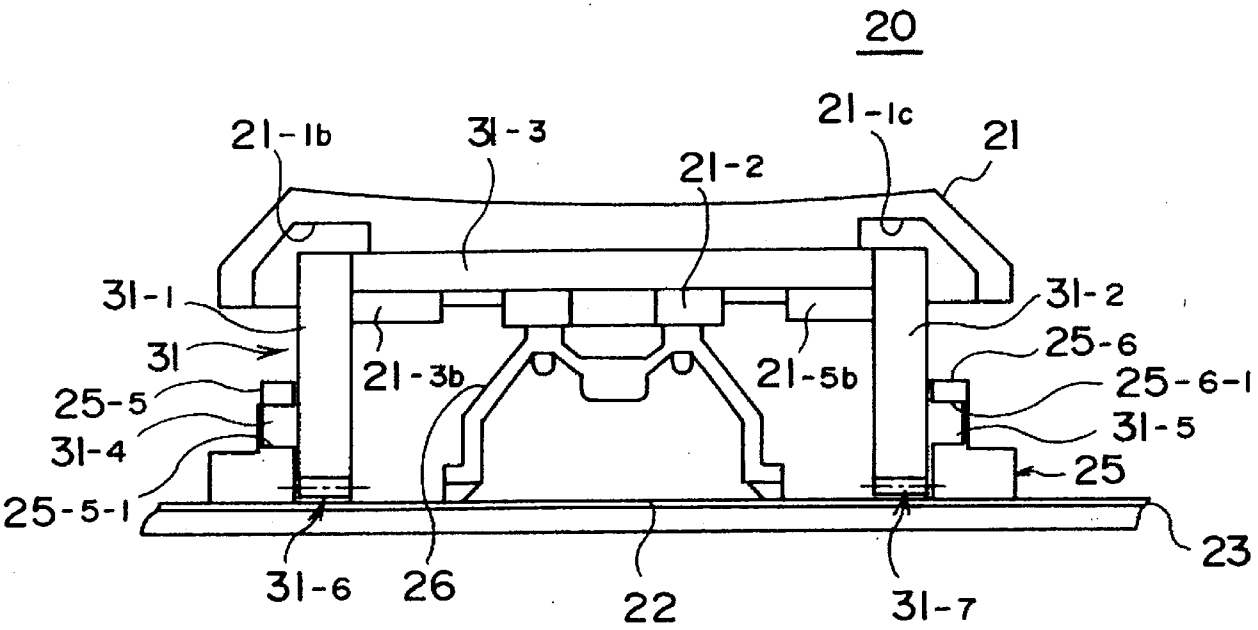
FIGS. 5A and 5B are diagrams showing the construction of the keyswitch of the first embodiment in an elevational cross sectional view taken along a line IV—IV of FIG. 3 for various states thereof.
Figure 5B:
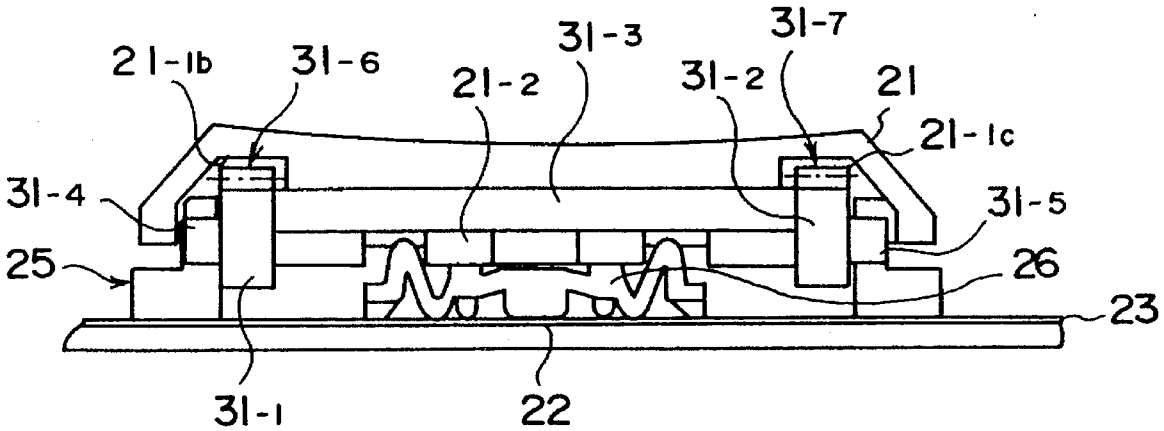

FIGS. 2A–2C show a keyswitch 20 according to a first embodiment of the present invention in an exploded view, while FIG. 3 shows the same keyswitch 20 in a plan view. Further, FIGS. 4A–4C show the keyswitch 20 in a cross sectional view taken along a line III—III of FIG. 3 for various states of the keyswitch, and FIGS.5A and 5B show the keyswitch 20 in a cross sectional view taken along a line IV—IV of FIG. 3 for two different operational states.

Referring to the drawings, the keyswitch 20 is formed of a plurality of components including a keytop 21 adapted for being pressed down by a finger of an operator, a membrane sheet 23 of a PET film including a membrane switch 22 therein, a rigid support panel 24 supporting thereon the membrane sheet 23, and a key housing 25 fixed on the support panel 24 so as to sandwich the membrane sheet 23 vertically together with the support panel 24. The key housing 25 thereby forms a frame structure that exposes the part of the membrane sheet 23 on which a contact of the membrane switch 22 is printed, and a deformable rubber actuator 26 is provided on the exposed part of the membrane 23. It should be noted that the actuator 26 thus provided is interposed between the keytop 21 and the membrane sheet 23, and transmits a force applied to the keytop 21 by the finger of the operator to the membrane switch 22 by causing an elastic deformation.

It should be noted that the keytop 21 of the keyswitch 20 is supported on the key housing 25 by a link mechanism 27, wherein the link mechanism 27 allows a free movement of the keytop 21 to and from the key housing 25 and hence the membrane 23, with a stroke sufficient for providing the operator a sense of actuating the keytop 21.

As indicated in FIG. 2B, the link mechanism 27 includes a first link member 31 of a U-shaped form and a second link member 32 also of a U-shaped form, wherein the first and second link members 31 and 32 may be formed of a polyacetal resin and are mounted upon the key housing 25 in a state to form together a V-shaped structure.

More specifically, the first link member 31 includes first and second arms $\mathbf{31}_{-1}$ and $\mathbf{31}_{-2}$ connected with each other by a bridging part $\mathbf{31}_{-3}$ that act also as a slider as will be explained later, wherein each of the first and second arms $\mathbf{31}_{-1}$ and $\mathbf{31}_{-2}$ carries a pivoting pins $\mathbf{31}_{-4}$ or $\mathbf{31}_{-5}$ at a free end thereof for engagement with a corresponding bearing hole $\mathbf{25}_{-5-1}$ or $\mathbf{25}_{-6-1}$, the bearing holes $\mathbf{25}_{-5-1}$ and $\mathbf{25}_{-6-1}$ being provided respectively in flange parts $\mathbf{25}_{-5}$ and $\mathbf{25}_{-6}$ formed on a top surface of the key housing 25. See FIG. 2C.

Similarly, the second link member 32 include first and second arms $\mathbf{32}_{-1}$ and $\mathbf{32}_{-2}$ connected with each other by a bridging part $\mathbf{32}_{-3}$ that act also as a slider as will be explained later, wherein each of the first and second arms $\mathbf{32}_{-1}$ and $\mathbf{32}_{-2}$ carries a pivoting pin $\mathbf{32}_{-4}$ or $\mathbf{32}_{-5}$ at a free end thereof for engagement with a corresponding bearing hole $\mathbf{25}_{-5-2}$ or $\mathbf{25}_{-6-2}$, the bearing holes $\mathbf{25}_{-5-2}$ and $\mathbf{25}_{-6-2}$ being provided respectively in flange parts $\mathbf{25}_{-5}$ and $\mathbf{25}_{-6}$ formed on a top surface of the key housing 25 adjacent to the bearing holes $\mathbf{25}_{-5-1}$ and $\mathbf{25}_{-6-1}$ respectively. See FIG. 2C.

It should be noted that the arms $\mathbf{31}_{-1}$ and $\mathbf{31}_{-2}$ carry toothed parts $\mathbf{31}_{-6}$ and $\mathbf{31}_{-7}$ at respective free ends thereof. Similarly, the arms $\mathbf{32}_{-1}$ and $\mathbf{32}_{-2}$ carry toothed parts $\mathbf{32}_{-6}$ and $\mathbf{32}_{-7}$ at respective free ends thereof. Thereby, the toothed part $\mathbf{31}_{-6}$ of the arm $\mathbf{31}_{-1}$ and the toothed part $\mathbf{32}_{-6}$ of the arm $\mathbf{32}_{-1}$ mesh with each other in the state that the pin $\mathbf{31}_{-4}$ is held in the bearing hole $\mathbf{25}_{-5-1}$ and the pin $\mathbf{32}_{-4}$ is held in the bearing hole $\mathbf{25}_{-5-2}$. Similarly, the toothed part $\mathbf{31}_{-7}$ of, the arm $\mathbf{31}_{-2}$ and the toothed part $\mathbf{32}_{-7}$ of the arm $\mathbf{32}_{-2}$ mesh with each other in the state that the pin $\mathbf{31}_{-5}$ is held in the bearing hole $\mathbf{25}_{-6-1}$ and the pin $\mathbf{32}_{-5}$ is held in the bearing hole $\mathbf{25}_{-6-2}$. As a result of the engagement of the toothed parts $\mathbf{31}_{-6}$ and $\mathbf{32}_{-6}$ as well as the engagement of the toothed parts $\mathbf{31}_{-7}$ and $\mathbf{32}_{-7}$, the first and second link members 31 and 32 are held in such a state that the arms $\mathbf{31}_{-1}$ and $\mathbf{32}_{-1}$ form a V-shaped form and the arms $\mathbf{31}_{-2}$ and $\mathbf{32}_{-2}$ form another V-shaped form.

Thereby, it will be noted that, when one of the link members 31 and 32 is tilted in a first direction, the other link member is tilted in a second opposite direction.

As already noted, the key housing 25 includes the flange parts $25_{-5}$ and $25_{-6}$, wherein the flange parts $25_{-5}$ and $25_{-6}$ are formed on a rectangular base member $25_{-1}$ of the key housing 25 with a separation in a direction $Y_1$-$Y_2$, and a circular cutout $25_{-2}$ is formed on the base member $25_1$ between the flange parts $25_{-5}$ and $25_{-6}$ for accepting the actuator 26 therein. It will be noted that the flange parts $25_{-5}$ and $25_{-6}$ extend parallel with each other in a direction $X_1$-$X_2$, and the base member $25_1$ is formed with elongated grooves $25_{-3}$ and $25_{-4}$ at the inner side of the flange parts $25_{-5}$ and $25_{-6}$, such that the groove $25_{-4}$ accepts the toothed parts $31_{-7}$ and $32_{-7}$ therein. Similarly, the elongated groove $25_{-3}$ accepts therein the toothed parts $31_{-6}$ and $32_{-6}$. By forming the grooves $25_{-3}$ and $25_{-4}$ as such, it is possible to form the bearing holes $25_{-5-1}$, $25_{-5-2}$, $25_{-6-1}$ and $25_{-6-2}$ at a level flush to the top surface of the base member $25_{-1}$, and the height of the keyswitch 20 is reduced substantially.

Figure 7:
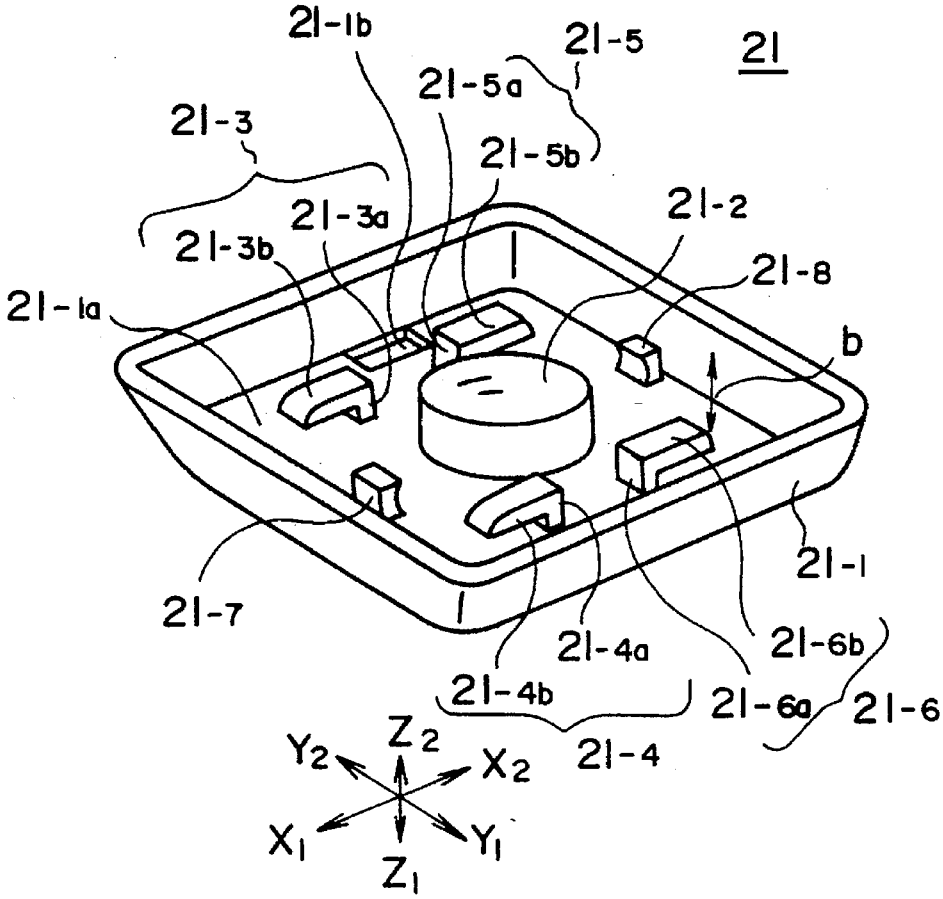
FIG. 7 is a diagram showing the keytop of the first embodiment in a turned over state.

FIG.7 shows the keytop 21 of FIG. 2A in a turned over state.

Referring to FIG.2A and further to FIG. 7, it will be noted that the keytop 21 has a flat rectangular shape defined by a wide keytop surface $21_{-1}$ adapted for being pressed down by the finger of the operator. At the bottom side or rear side of the keytop 21, it will be noted that a space $21_{-1a}$ of a depth b is formed, and a columnar pillar $21_{-2}$ of a circular cross section extends in the space $21_{-1a}$ from a bottom surface of the keytop 21 in the downward direction. Thereby, that the columnar pillar $21_{-2}$ presses the rubber actuator 26 accommodated in the circular cutout $25_{-2}$ of the base member $25_{-1}$ of the key housing 25 as will be explained later.

Further, it will be noted that the keytop 21 carries, on the bottom surface thereof, guide members $21_{-3}$ and $21_{-6}$, wherein the guide member $21_{-3}$ includes a guide rail part $21_{-3b}$ and a stopper part $21_{-3a}$ continuing from the guide rail part $21_{-3b}$, wherein the stopper part $21_{-3a}$ connects the guide rail $21_{-3b}$ to the bottom surface of the keytop 21 at an end of the guide rail part $21_{-3b}$. Thereby, the guide rail part $21_{-3b}$ extends in the $X_1$-direction from the stopper part $21_{-3a}$. Other guide members $21_{-4}$–$21_{-6}$ have a similar construction, except that the guide rail part $21_{-5b}$ and $21_{-6b}$ extend from the respective stopper parts $21_{-5a}$ and $21_{-6a}$ in the $X_2$-direction.

It should be noted that the guide members $21_{-3}$ and $21_{-4}$ guide together the bridging part $31_{-3}$ of the first link member 31 along the bottom surface of the keytop 21. Similarly, the guide members $21_{-5}$ and $21_{-6}$ guide together the bridging part $32_{-3}$ of the second link member 32. More specifically, the bridging part $31_{-3}$ of the link member 31 is accepted in a space formed between the guide rail $21_{-3b}$ and the bottom surface of the keytop 21 as well as in the space formed between the guide rail $21_{-4b}$ and the bottom surface of the keytop 21, wherein the bridging part $31_{-3}$ moves freely in the $X_1$-$X_2$ directions except for restraint caused by the stopper parts $21_{-3a}$ and $21_{-4a}$. Similarly,the bridging part $32_{-3}$ of the link member 32 is accepted in a space formed between the guide rail $21_{-5b}$ and the bottom surface of the keytop 21 as well as in the space formed between the guide rail $21_{-6b}$ and the bottom surface of the keytop 21, wherein the bridging part $32_{-3}$ moves freely in the $X_1$-$X_2$ directions except for the restraint caused by the stopper parts $21_{-5a}$ and $21_{-6a}$.

As a result, the keytop 21 is held movably in a direction $Z_1$-$Z_2$ on the key housing 25 by the link mechanism 27. Thereby, as will be explained in detail below, the bridging part $31_{-3}$ engages the stopper parts $21_{-3a}$ and $214_{-4a}$ when the keytop 21 is in the free, unactuated state where the bridging part $31_{-3}$ is urged in the $X_1$-direction. In the unactuated state, it should be noted that the bridging part $32_{-3}$ is urged also in the $X_2$-direction and engages the stopper parts $21_{-5a}$ and $21_{-6a}$. As a result of the foregoing engagement of the bridging parts $31_{-3}$ and $32_{-3}$, further movement of the keytop 21 in the upward direction is effectively prevented, and the height of the keytop 21 in the unactuated state is determined thereby.

Further, in order to restrain the excessive movement of the bridging parts $31_{-3}$ and $32_{-3}$ respectively in the $X_1$- and $X_2$-directions in the state that the keytop 21 is pressed down by the operator, the keytop 21 carries on the bottom surface thereof stoppers $21_{-7}$ and $21_{-8}$ respectively for engagement with the bridging part 31.and the bridging part $32_{-3}$. Thereby, the stopper $27_{-7}$ is provided at a location offset by a distance e from the stopper parts $21_{-3a}$ and $214_{-4a}$ in the $X_1$-direction, wherein the distance e is set slightly smaller than a diameter d of the bridging part $31_{-3}$, as indicated in the plan view of FIG. 3, in order to facilitate assembling of the keyswitch 20. Similarly, the stopper $21_{-8}$ is provided with the offset e from the stopper parts $21_{-5a}$ and $21_{-6a}$ in the $X_2$-direction.

In such a construction of the keyswitch 20, it will be noted that the bridging parts $31_{-3}$ and $32_{-3}$ slide laterally along the bottom surface of the keytop 21 in the $X_1$- and $X_2$-directions, upon actuation of the keytop 21 vertically in the $Z_1$- and $Z_2$-directions. Because of the lateral movement of the bridging parts $31_{-3}$ and $32_{-3}$, the keyswitch 20 has a preferable feature of reduced overall height. As already noted, the cylindrical pillar $21_{-2}$ at the central part of the keytop 21 actuates the membrane switch 22 in the membrane sheet 23 via the rubber actuator 26 by causing an elastic deformation in the rubber actuator 26.

Next, actuation of the keyswitch 20 will be described with reference to FIGS. 4A–4C and FIG. 5A and 5B.

Referring to FIG. 4A showing the keyswitch 20 in an unactuated state, the keytop 21 is pushed upward in the $Z_1$-direction by the rubber actuator 26 and is held at a height $H_{11}$ by the link members 31 and 32 that form together the link mechanism 27, wherein the arms of the link members 31 and 32 form an angle r of about 70 degrees therebetween in the state of FIG. 5A where the bridging part $31_{-3}$ engages the stopper part $21_{-3a}$ and the bridging pat $32_{-3}$ engages the stopper part $21_{-5a}$. In FIG. 4A, it will be noted that the keytop 21 has an overall height as a sum of a thickness $t_2$ of the keytop 21 and a height $H_{13}$ of the stopper members $21_{-7}$ and $21_{-8}$. On the other hand, the key housing 25 has a height $H_{12}$ at the top surface of the base member $25_{-1}$ thereof,and the keytop 21 is lifted above the key housing 25 by the link mechanism 27 with a distance $H_{14}$.

Upon pressing down of the keytop 21 by applying a force F in the direction $Z_2$ at a point $P_1$ as indicated in FIG. 4A, the keytop 21 subsides in the direction $Z_2$ as indicated in FIG. 4B as a result of tilting of the link members 31 and 32. Thereby, it should be noted that, because of the engagement of the link members 31 and 32 at the toothed parts $31_{-6}$ and $32_{-6}$, the link members 31 and 32 tilt in respective, opposite directions, with the same angle of tilting. Thus, the link member 31 tilts in the counter-clockwise direction while the link member 32 tilts in the clockwise direction in the illustration of FIG. 4B. As a result, the bridging parts $31_{-3}$ and $32_{-3}$ slide respectively in the $X_1$- and $X_2$-directions, and the keytop 21 sinks in the $Z_1$-direction while maintaining a parallel relationship with respect to the keytop 21 in the state of FIG. 4A.

With further pressing of the keytop 21, the link members 31 and 32 tilt further in the counter-clockwise direction and in the clockwise direction respectively as indicated in FIG. 4C, until the link member 31 engages the stopper $\mathbf{21}_{-7}$ and the link member 32 engages the stopper $\mathbf{21}_{-8}$. In this state, further lowering of the keytop 21 does not occur even when pressed further due to the foregoing engagement of the link members 31 and 32 with the respective stoppers $\mathbf{21}_{-7}$ and $\mathbf{21}_{-8}$.

In the state of FIG.4C, it will be noted that the link member 31 is tilted in the counter-clockwise direction with an angle Θ while the link member 32 is tilted in the clockwise direction with the same angle e, and the keytop 21 has been lowered for a stroke S from an initial level $Q_1$ corresponding to the state of FIG. 4A, to a final level $Q_2$, while maintaining a parallel relationship with the state of FIG. 4A.

Figure 6:
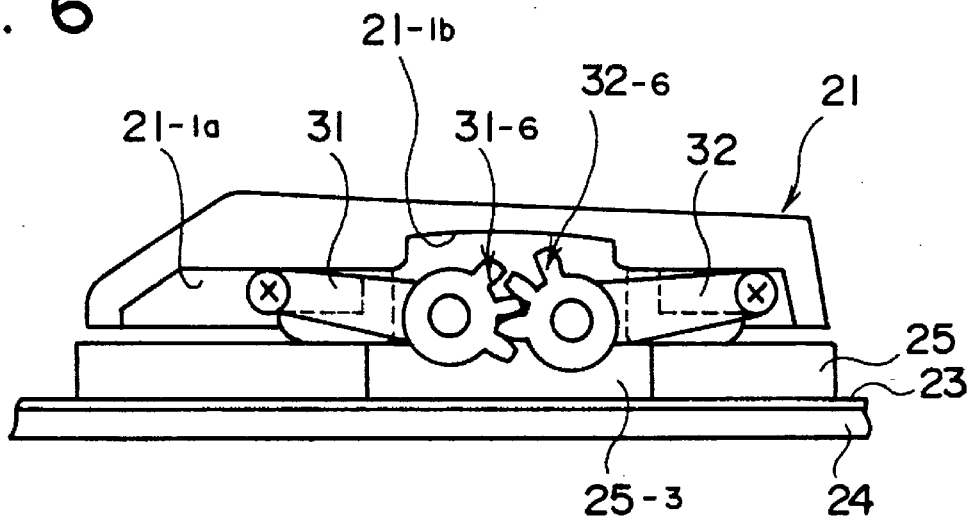
FIG. 6 is a diagram showing the construction of the keyswitch of the first embodiment in an elevational cross sectional view taken along a line V—V in the actuated state.

In the state of FIG. 4C, the angle Θ is about 50 degrees, and thus, the link members 31 and 32 form an increased angle r of about 170 degrees therebetween. Thereby, it should be noted that the link members 31 and 32 are accommodated in the space $\mathbf{21}_{-1a}$ formed under the keytop 21. Further, the toothed parts $\mathbf{31}_{-6}$ and $\mathbf{32}_{-6}$ are accommodated in a depression $\mathbf{21}_{-1b}$ formed on the bottom surface of the keytop 21. See the cross sectional view of FIG. 6 as well as FIG. 7 that shows the bottom side of the keytop 21. As a result, the link mechanism 27 is entirely hidden under the keytop 21. In other words, the link mechanism 27 does not cause any increase in the height of the keyswitch 20.

FIGS. 5A and 5B show the state of actuation of the keyswitch 20 in a cross sectional view as viewed from a different angle.

Referring to FIG. 5A showing the state corresponding to the state of FIG. 4A, the keytop 21 is urged in the upward direction by the rubber actuator 26 that pushes the columnar pillar $\mathbf{21}_{-2}$ at the bottom side of the keytop 21.

Upon pressing down of the keytop 21, the rubber actuator 26 collapses as indicated in FIG. 5B, wherein the rubber actuator 26 actuates the membrane switch 22 printed on the membrane sheet 23. As further lowering of the keytop 21 is prevented by the engagement of the link members 31 and 32 with the stopper parts $\mathbf{21}_{-7}$ and $\mathbf{21}_{-8}$ as already noted, the problem of the membrane switch 22 being pressed excessively is successfully eliminated in the state of FIG. 5A.

Upon release of the keytop 21, the rubber actuator 26 restores the original shape, and the keytop 21 is pushed in the upward direction. Thereby, the state of FIG. 5A is restored.

In the operation of FIGS. 4A–4C as well as of FIGS.5A and 5B, it will be noted that the movement of the keytop 21 in the $Z_1$- and $Z_2$-directions occurs while maintaining a parallel relationship with the state of FIG. 4A, irrespective of whether the force F is applied to the point $P_1$ at the center of the keytop 21 or to other points $P_2$ or $P_3$ offset from the center $P_1$, due to the engagement of the link members 31 and 32 at the toothed arts $\mathbf{31}_{-6}$ and $\mathbf{32}_{-6}$ or $\mathbf{31}_{-7}$ and $\mathbf{32}_{-7}$. Due to the formation of,the toothed parts in the link members 31 and 32, a reliable engagement of the link members is guaranteed during the actuation of the keytop 21.

Figure 1A:
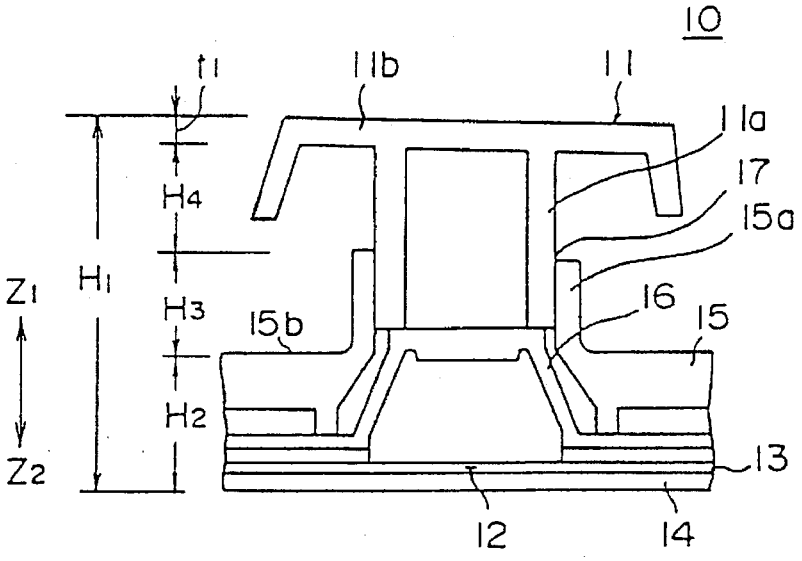
FIG. 1A PRIOR ART
FIGS. 1A and 1B are diagrams showing the construction of a conventional keyswitch respectively in a state before actuation and in a state after actuation.
Figure 1B:
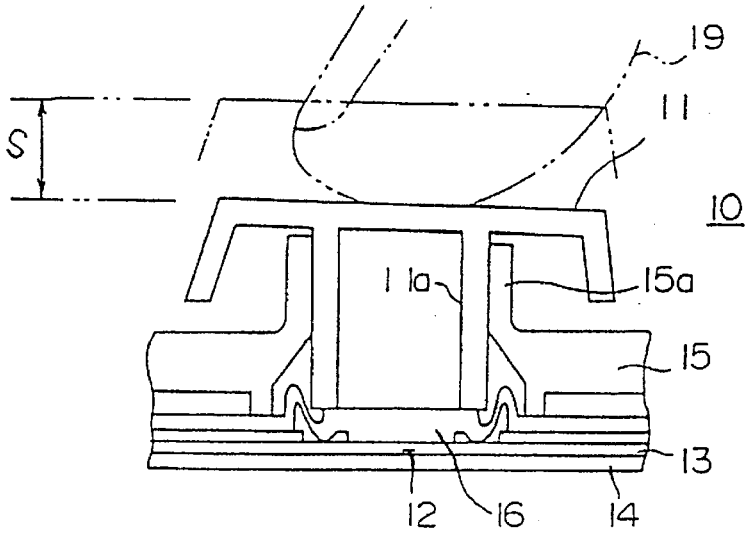
FIG. 1B PRIOR ART

Typically, the height $H_{14}$ of the link mechanism 27 is set to be about 3 mm. Thereby, a stroke of about 3 mm is secured for the stroke S of the keytop 21 and the keyswitch 20 provides a positive feeling of actuation to the operator, while simultaneously reducing the overall height $H_{11}$. In the keyswitch 20 of the present invention wherein the sleeve guides used in the conventional keyswitch 10 are eliminated, the overall keyswitch height $H_{11}$ can be reduced by the amount corresponding to the height $H_3$ shown in FIG. 1A. The amount of reduction of the keyswitch height thus achieved reaches as much as 2.5 mm as compared with the keyswitch 10, assuming that $t_2=t_1$ and $H_{12}=H_2$. Typically, the height $H_{11}$ of the keyswitch 20 is about 8.5 mm.

In the keyswitch 20 of the present embodiment, any dust particles penetrated to the bottom surface of the keytop 21 is scraped off therefrom by the scraping action of the bridging parts $\mathbf{31}_{-3}$ or $\mathbf{32}_{-3}$ that slide along the bottom surface of the keytop 21. As the bottom surface of the keytop 21 is-exposed, the dust particles thus scraped off escape freely. Thereby, the keyswitch 20 of the present invention is substantially immune to penetration of dusts.

Figure 8A:
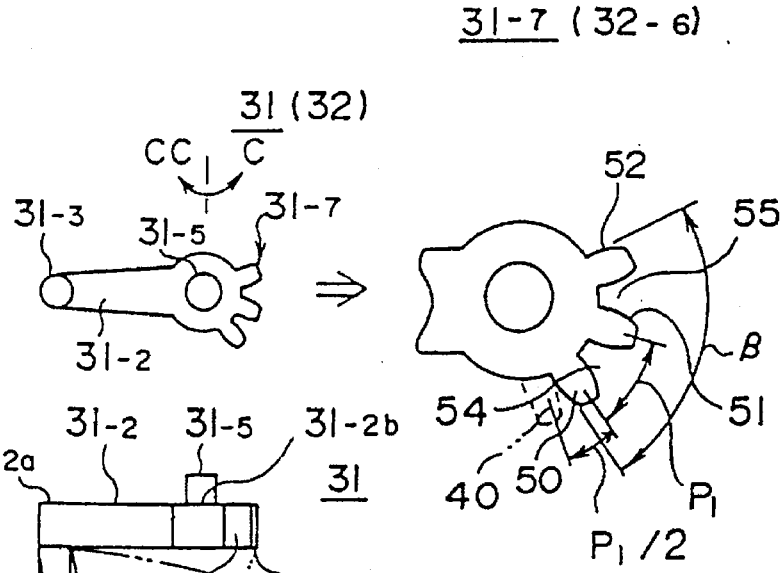
FIGS. 8A–8C are diagrams showing a part of the keyswitch of the first embodiment in exploded states.
Figure 8B:
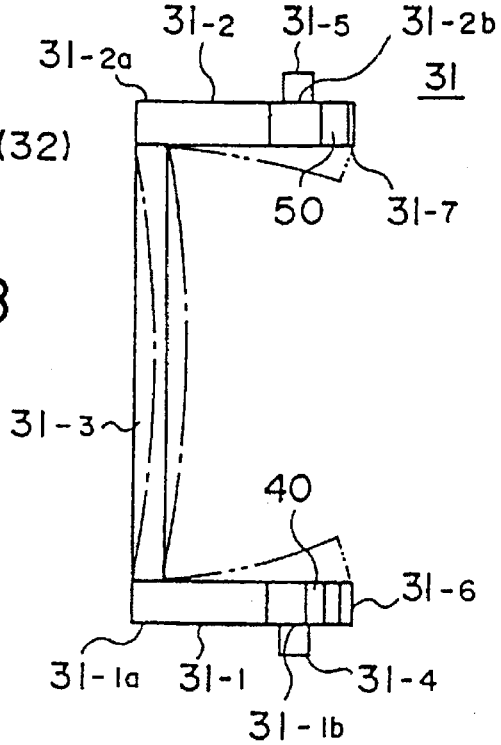
Figure 8C:
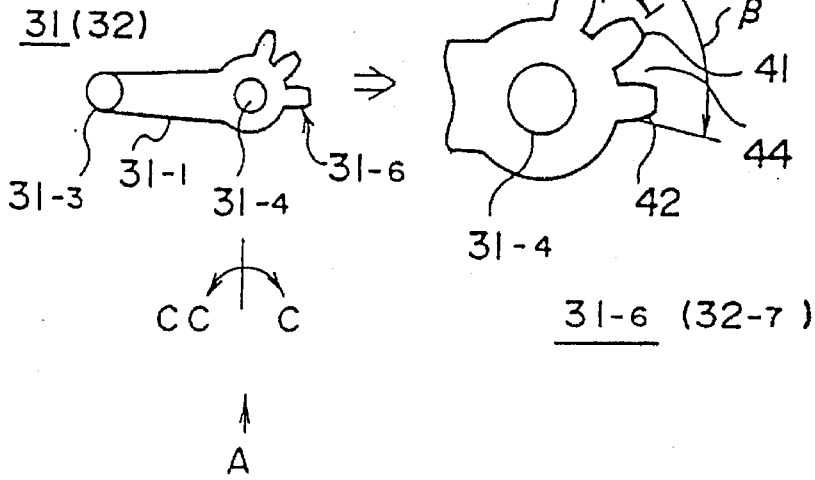

FIGS. 8A–8C show the construction of the link member 31 (or 32) used in the keyswitch 20 in detail, wherein FIG. 8A shows the arm $\mathbf{31}_{-2}$ and the pivot pin $\mathbf{31}_{-5}$ together with the toothed part $\mathbf{31}_{-7}$ surrounding the pivot pin $\mathbf{31}_{-5}$, while FIG. 8B shows the generally U-shaped construction of the link member $\mathbf{31}_{-3}$. Further, FIG. 8C shows the arm $\mathbf{31}_{-1}$ and the pivot pin $\mathbf{31}_{-4}$ together with the toothed part $\mathbf{31}_{-6}$ surrounding the pivot pin $\mathbf{31}_{-4}$.

Referring to FIG. 8A, it will be noted that the toothed part $\mathbf{31}_{-7}$ is formed for a limited angle β around the pivot pin $\mathbf{31}_{-5}$ and includes teeth 50–52 formed with a pith $P_1$, with intervening grooves 54 and 55 formed therebetween. Similarly, the toothed part $\mathbf{31}_{-6}$ is formed for the same limited angle β around the pivot pin $\mathbf{31}_{-4}$ as indicated in FIG. 8C an includes teeth 40–42 formed with the same pith $P_1$, with intervening grooves 43 an 44 formed therebetween. It should be noted that similar teeth 40–42 and 50–52 are formed respectively on the toothed part $\mathbf{32}_{-7}$ and $\mathbf{32}_{-6}$, wherein the tooth 40 of the toothed part $\mathbf{32}_{-7}$ engages the tooth 50 of the toothed part $\mathbf{31}_{-7}$ as indicated in FIG. 8A.

It should be noted that the teeth 50–52 of the toothed part $\mathbf{31}_{-7}$ are formed primarily on the right hand side of the arm $\mathbf{31}_{-2}$ when viewed in the direction of the arm $\mathbf{31}_{-2}$ from the side of the bridging part $\mathbf{31}_{-3}$ as indicated in FIG. 8A, while the teeth 40–42 of the toothed part $\mathbf{31}_{-6}$ are formed primarily on the left hand side of the arm $\mathbf{31}_{-1}$ when viewed in the direction of the arm $\mathbf{31}_{-1}$ from the side of the bridging part $\mathbf{31}_{-3}$. Similarly, the teeth 50–52 of the toothed part $\mathbf{32}_{-7}$ are formed primarily on the right hand side of the arm $\mathbf{32}_{-2}$ when viewed in the direction of the arm $\mathbf{32}_{-2}$ from the side of the bridging part $\mathbf{32}_{-3}$, while the teeth 40–42 of the toothed part $\mathbf{32}_{-6}$ are formed primarily on the left hand side of the arm $\mathbf{32}_{-1}$ when viewed in the direction of the arm $\mathbf{32}_{-1}$ from the side of the bridging part $\mathbf{32}_3$. By providing the teeth for only a limited angular range β in the toothed parts $\mathbf{31}_{-6}$ and $\mathbf{31}_{-7}$ or $\mathbf{32}_{-6}$ and $\mathbf{32}_{-7}$, it is possible to reduce the height $H_{12}$ of the key housing 25 and hence the overall height $H_{11}$ of the keyswitch 20.

Further, as indicated in FIG. 8B, the link member 31 or 32 deforms elastically when being assembled to form the keyswitch 20.

Figure 9:
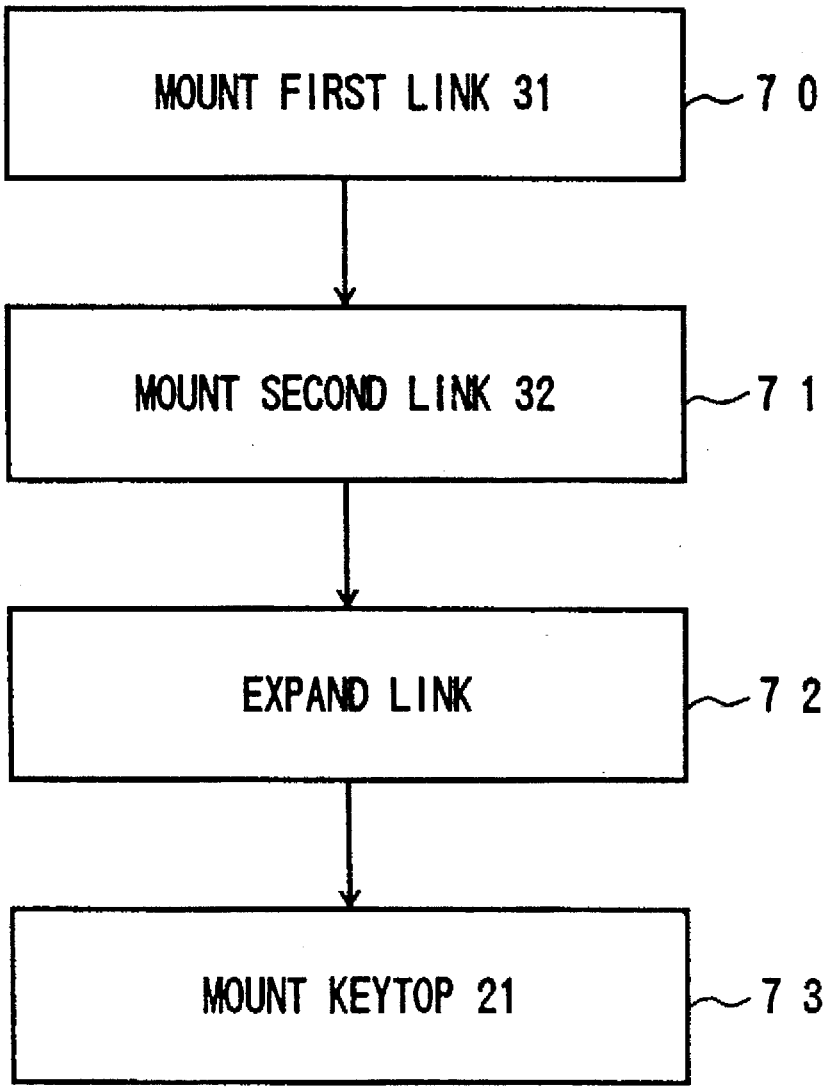
FIG. 9 is a flowchart showing the process of assembling the keyswitch of the first embodiment.

FIG. 9 shows the process of assembling the keyswitch 20 in the form of a flowchart.

Referring to FIG. 9, the first link member 31 is mounted upon the key housing 25 already carrying the rubber actuator 26 thereon, in a step 70, followed by a step 71 for mounting the second link member 32 further on the key housing 25. Thereby, the link mechanism 27 is assembled.

After the step 71, the link mechanism 27 is expanded such that the link members 31 and 32 form a maximum angle therebetween in a step 72, and the keytop 21 is mounted upon the link mechanism 27 thus expanded.

Figure 10A:
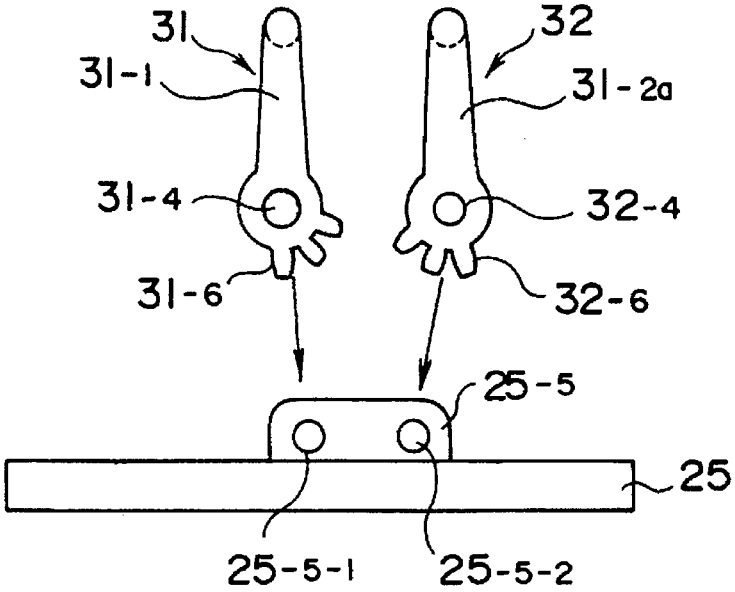
FIGS. 10A–10C are diagrams showing the steps of assembling the keyswitch of the first embodiment.
Figure 10B:
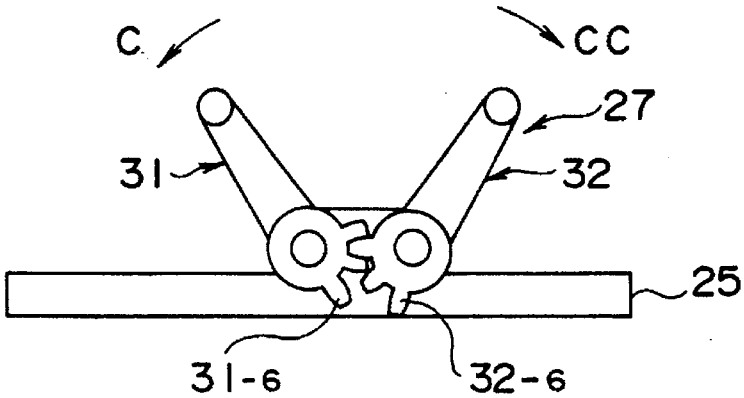
Figure 10C:
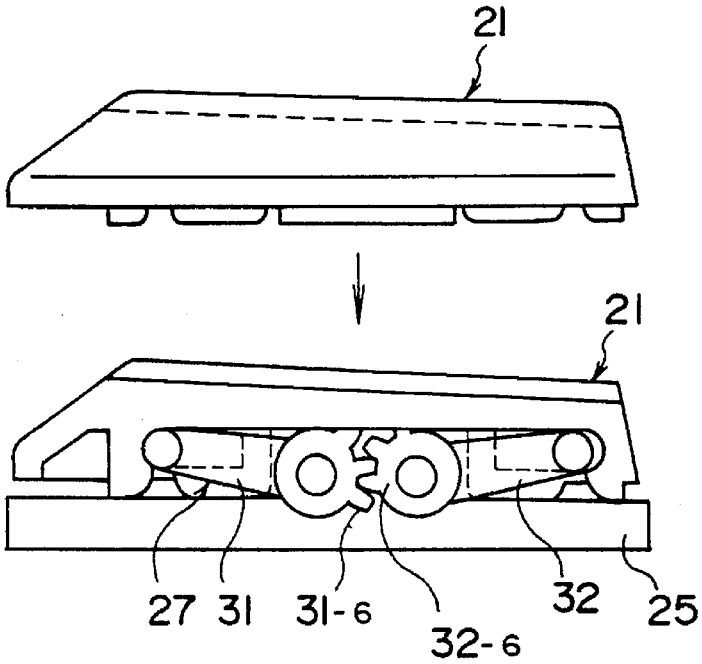

FIGS. 10A–10C show the assembling process of the keyswitch 20 according to the process of FIG. 9 step by step.

Referring to FIG. 10A, the link members 31 and 32 are mounted upon the key housing 25 by engaging the pivot pin $31_{-4}$ to the bearing hole $25_{-5-1}$ and the pivot pin $32_{-4}$ to the bearing hole $25_{-5-2}$, by causing a deformation in the link members 31 and 32 as indicated in FIG. 8B.

Next, in the step of FIG. 10B, the link members 31 and 32 are tilted as indicated by arrows, so that the toothed part $31_{-6}$ and the toothed part $32_{-6}$ are engaged with each other.

Further, in the step of FIG. 10C, the link members 31 and 32 are fully tilted, and the keytop 21 is pressed firmly thereon in this state, as indicated in FIG. 10C. Thereby, the link members 31 and 32 as well as the stopper parts $21_{-7}$ and $21_{-8}$ cause a resilient deformation, and the bridging part $31_{-3}$ as well as the bridging part $32_{-3}$ are accepted into the space formed by the guide member $21_{-3}$ as well as into the space formed by the guide member $21_{-5}$, respectively. As the bridging parts $31_{-3}$ and $32_{-3}$ have the diameter d that is slightly larger than the size e of the gap formed between the stopper part $21_{-3a}$ or $21_{-4a}$ and the stopper part $21_{-7}$ or between the stepper part $21_{-5a}$ or $21_{-6a}$ and the stopper part $21_{-8}$, the bridging parts thus engaged with the guide member do not come off easily.

As will be noted, the assembling of the keyswitch 20 of the present embodiment can be achieved without using tools.

Figure 11A:
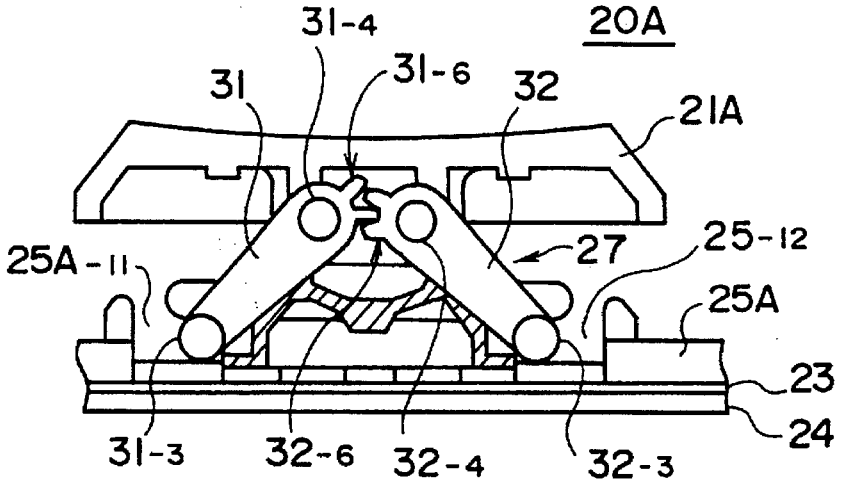
FIGS. 11A and 11B are diagrams showing the keyswitch according to a second embodiment of the present invention respectively in a state before actuation and in a state after actuation.
Figure 11B:
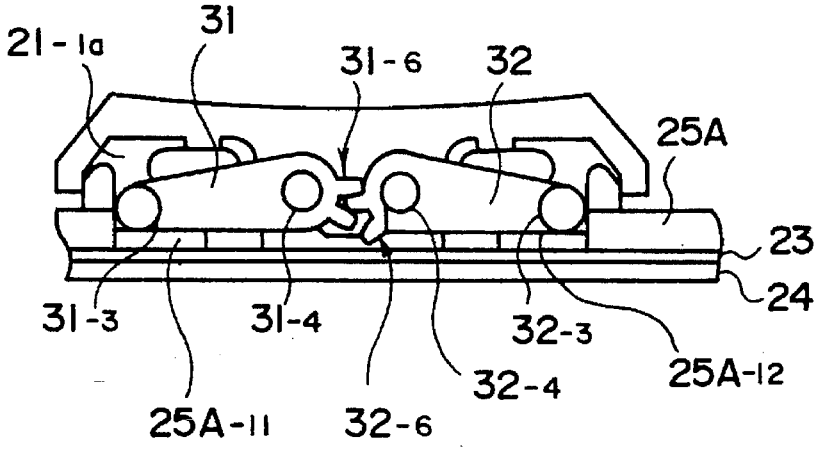

Next, a keyswitch 20A according to a second embodiment of the present invention will be described with reference to FIGS. 11A and 11B, wherein FIG. 11A shows the keyswitch 20A in an unactuated state while FIG. 11B shows the same keyswitch 20B in an actuated state. In FIGS. 11A and 11B, those parts described previously are designated by the same reference numerals and the description thereof will be omitted.

Referring to FIGS. 11A and 11B, the keyswitch 20A includes a keytop 21A in place of the keytop 21, wherein the keytop 21A holds the link members 31 and 32 in a state that the link members 31 and 32 are pivoted upon the keytop 21A at a root part thereof. Similarly to the previous embodiment, the link members 31 and 32 carry toothed parts at the root parts thereof and are meshed with each other such that the link members 31 and 32 tilt or swing in opposite directions simultaneously upon actuation of one of the link members. Thereby, the link members 31 and 32 form together an inverted V-shaped form.

In the keyswitch 21A, it should be noted that the bridging part $31_{-3}$ or $32_{-3}$ slide along a guide region $25A_{-11}$ or $25A_{-12}$ upon actuation of the keytop 21A in the vertical direction, wherein the guide region is provided on the top surface of a key housing 25A, rather than on the bottom surface of the keytop 21. In the fully pressed down state of FIG. 11B, it will be noted that the link members 31 and 32 are accommodated in the space $21_{-1a}$ formed below the keytop 21A.

In the present embodiment, too, the keytop 21A is maintained horizontal while being moved up and down as a result of engagement of the link members 31 and 32.

Next, a keyswitch 20B according to a third embodiment of the present invention will be described.

Figure 12A:
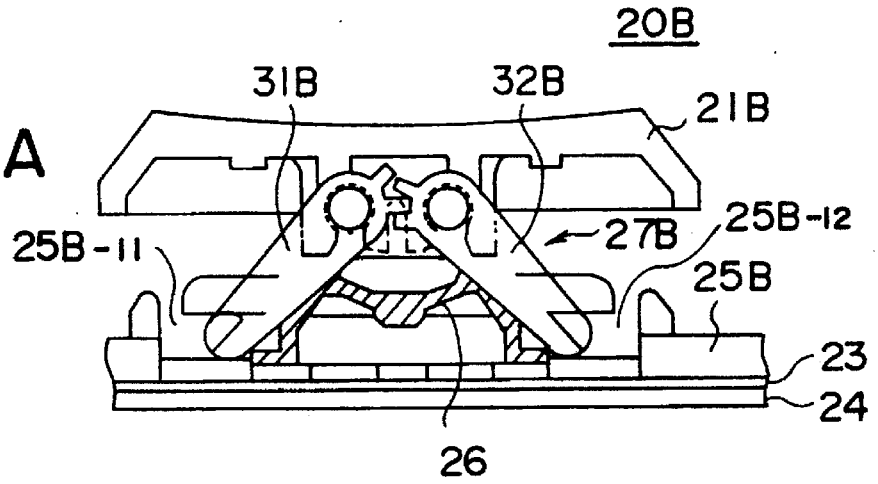
FIGS. 12A and 12B are diagrams showing the construction of a keyswitch according to a third embodiment of the present invention respectively in a state before actuation and in a state after actuation.
Figure 12B:
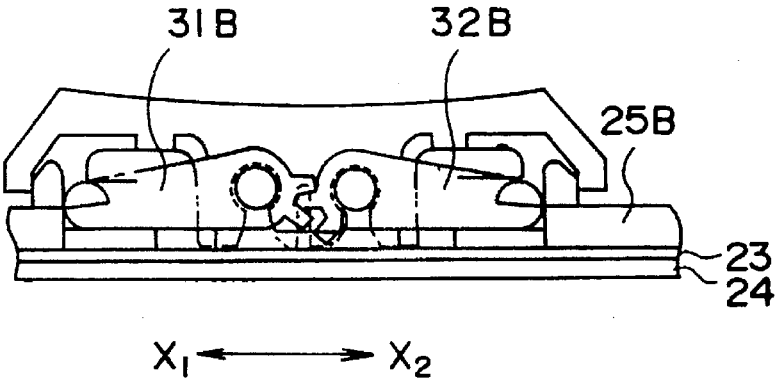

FIGS. 12A and 12B show the keyswitch 20B respectively in the state before actuation and after actuation.

Referring to FIGS. 12A and 12B, the keyswitch 20B includes a keytop 21B supported on a key housing 25B via a link mechanism 2B that includes a first link member 31B and a second link member 32B that engage with each other, similarly to the previous embodiment. In the state of FIG. 12A where the keytop 21B is released, the rubber actuator 26 pushes the keytop 21B in the upward direction and the link members 31B and 32B form an inverted V-shaped form.

In the state of FIG. 12B where the keytop 21B is pressed down, on the other hand, the link members 31B and 32B are flattened. Thereby, the link members 31B and 32B slide along guide mechanisms $25B_{-11}$ and $25B_{-12}$ that are formed on the key housing 25B.

Figure 13A:
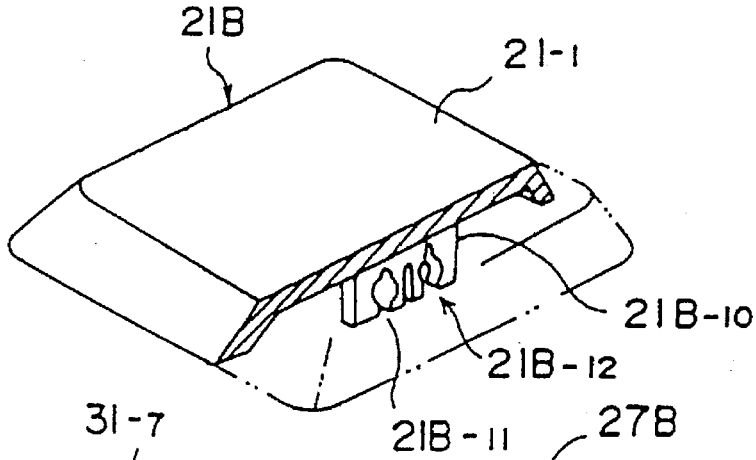
FIG. 13A–13C are diagrams showing the keyswitch of the third embodiment in an exploded view.
Figure 13B:
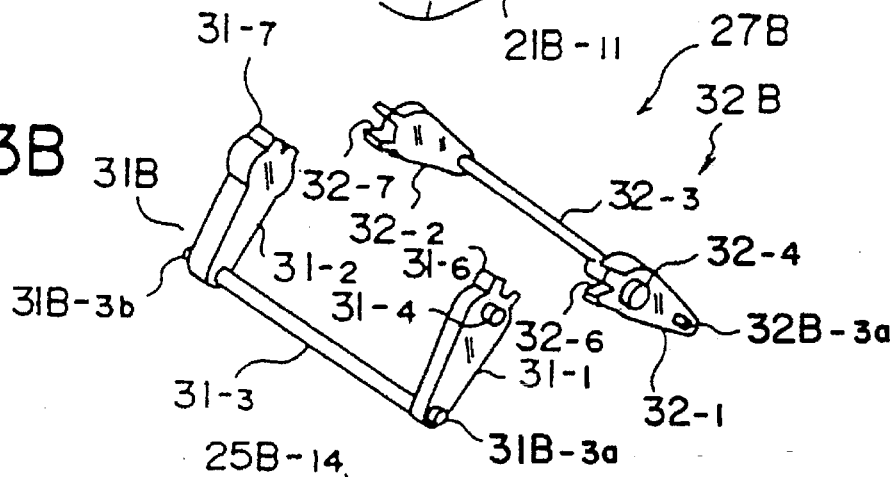
Figure 13C:
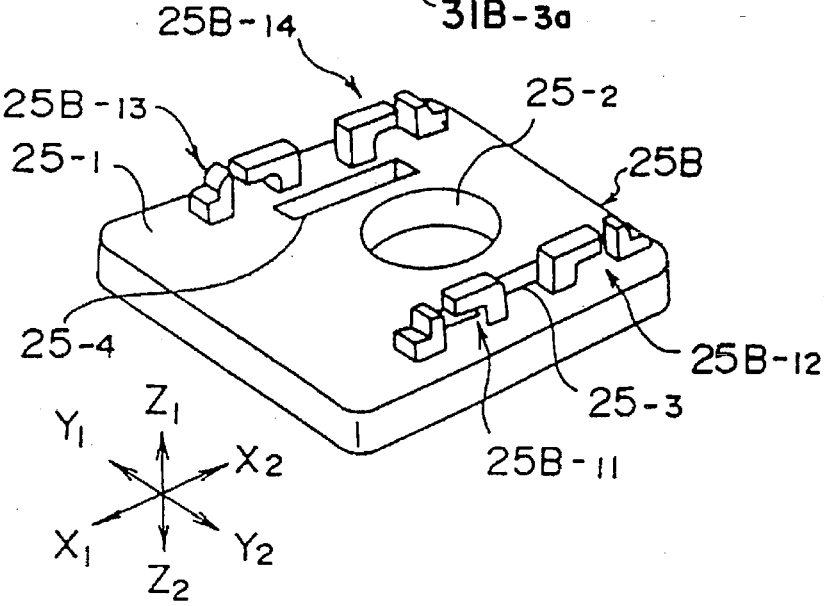

FIGS.13A–13C show the keyswitch 20B in an exploded view. In FIGS. 13A–13C, those parts corresponding to the parts described previously are designated by the same reference numerals and the description thereof will be omitted.

Figure 14:
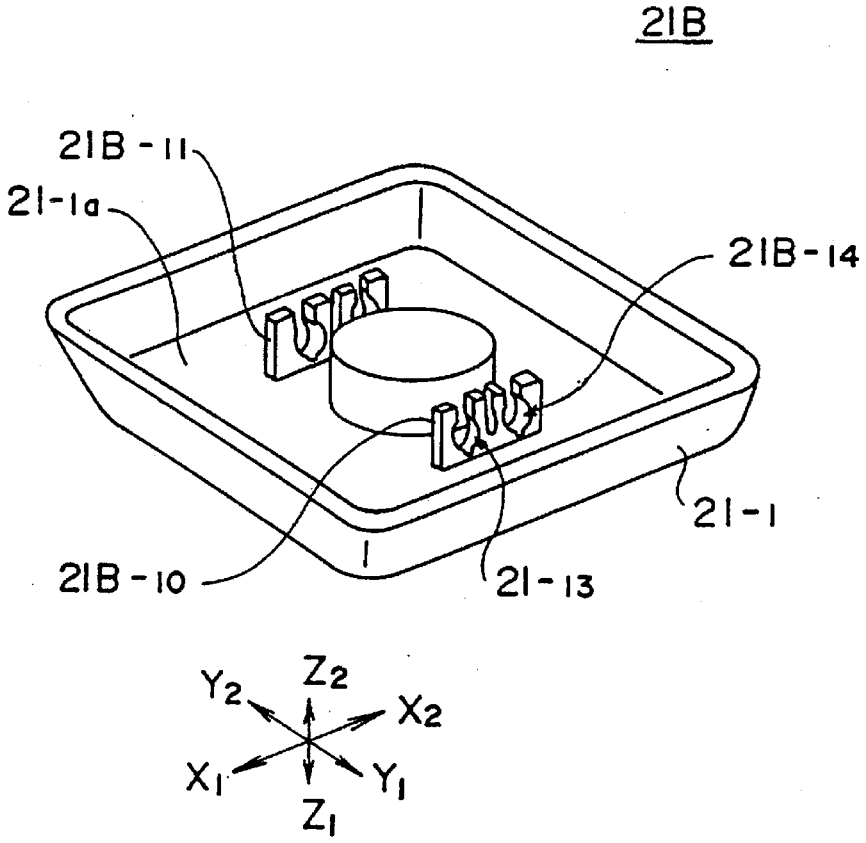
FIG. 14 is a diagram showing a keytop used in the keyswitch of the third embodiment in a turned over state.

Referring to FIGS. 13A–13C, the keytop 21B carries on the bottom surface thereof a rib $21B_{-10}$ that is formed with cutouts $21B_{-11}$ and $21B_{-12}$ respectively acting as bearing parts for accepting the pivot pins $31_{-4}$ and $32_{-4}$ of the link members 31B, 32B. A similar rib $21B_{-11}$ in the $Y_1$-$Y_2$ directions as indicated in the bottom view of the keytop 21B of FIG. 14, and the link members 31B and 32B are mounted upon the bottom side of the keytop 21B in a manner to swing freely about the pivot pins $31_{-4}$ and $32_{-4}$, respectively.

Further, the link member 31B includes projections $31B_{-3a}$ and $31B_{-3b}$ respectively on the arms $31_{-1}$ and $31_{-2}$ as an extension of the bridging part $31_3$, wherein the projection $31B_{-3a}$ and $31B_{-3b}$ engage the guide mechanisms $25B_{-11}$ and $25B_{-13}$ respectively formed on the top surface of the rectangular base member $25_{-1}$ forming the key housing 25B, as indicated in FIG. 13C. Thereby, the bridging part $31_{-3}$ of the link member 31B is guided along the top surface of the base member $25_{-1}$ of the key housing 25. Similarly, the link member 32B includes projections $32B_{-3a}$ and $32B_{-3b}$ respectively on the arms $32_{-1}$ and $32_{-2}$ as an extension of the bridging part $32_{-3}$, wherein the projection $32B_{-3a}$ and $32B_{-3b}$ ($32B_{-3a}$ not shown in FIG. 13B) engage the guide mechanisms $25B_{-14}$ and $25B_{-12}$ respectively formed on the top surface of the base member $25_{-1}$. Thereby the bridging part $32_{-3}$ of the link member 32B is guided along the top surface of the base member $25_{-1}$ similarly to the bridging part $31_{-3}$ of the link member 31B. Thus, it will be noted that the bridging parts $31_{-3}$ and $32_{-3}$ are caused to slide freely along the top surface of the base member $25_{-1}$ in the $X_1$- and $X_2$-directions, while being pivoted at the cutouts $21B_{-11}$ and $21B_{-12}$ formed on the bottom side of the keytop 21B.

Figure 15:
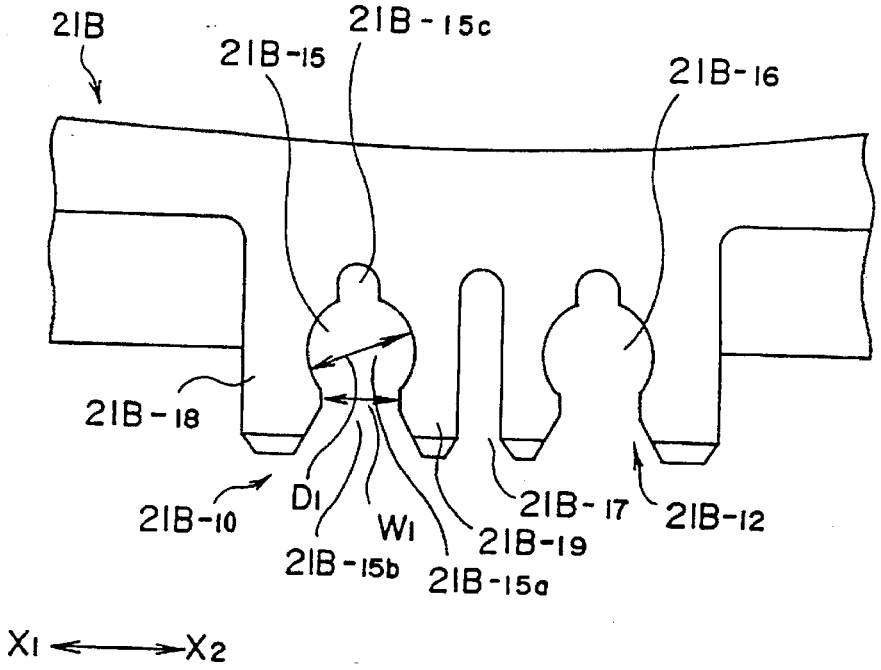
FIG. 15 is a diagram showing a part of the keytop of FIG. 14 in an enlarged scale.

FIG. 15 shows the construction of the rib $21B_{-10}$ in detail.

Referring to FIG. 15, the rib $21B_{-10}$ is divided into a first part and a second part by a central slit $21B_{-17}$, wherein the first part is formed with a cutout $21B_{-15}$ defined laterally by a first finger part $21B_{-18}$ and a second finger part $21B_{-19}$, wherein the cutout $21B_{-15}$ includes a mouth part $21B_{-15b}$ 15*b* that reduces a width $W_1$ thereof toward the interior of the cutout $21B_{-15}$ and a circular inner part $21B_{-15a}$ continuing from the mouth part $21B_{-15b}$. The circular inner part $21B_{-15a}$ has a diameter $D_1$ larger than the width $W_1$ at the part where the inner part $21B_{-15a}$ continues to the mouth part $21B_{-15b}$. Further, a cut $21B_{-15c}$ of a reduced width penetrates further toward the interior of the cutout $21B_{-15}$, and the fingers $21B_{-18}$ and $21B_{-19}$ cause a resilient deformation when being engaged with the pin $31_{-4}$ at the time of assembling of the keyswitch as will be explained in detail later. Thereby, the circular part $21B_{-15a}$ acts as a bearing of the pin $31_{-4}$. The second part of the rib $21B_{-10}$ has a similar structure and includes a circular cut $21B_{-16}$ acting as a bearing of the pin $32_{-4}$.

As the rib $21B_{-11}$ has a similar structure, the description thereof will be omitted.

Figure 16A:
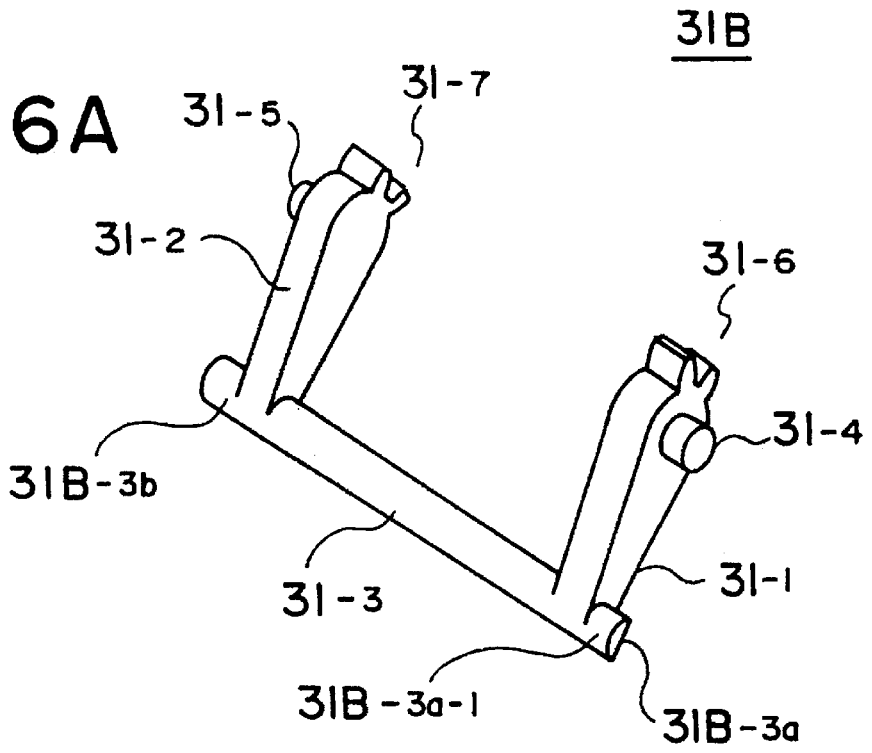
FIGS. 16A and 16B are diagrams showing the construction of links used in the keyswitch of the third embodiment.
Figure 16B:
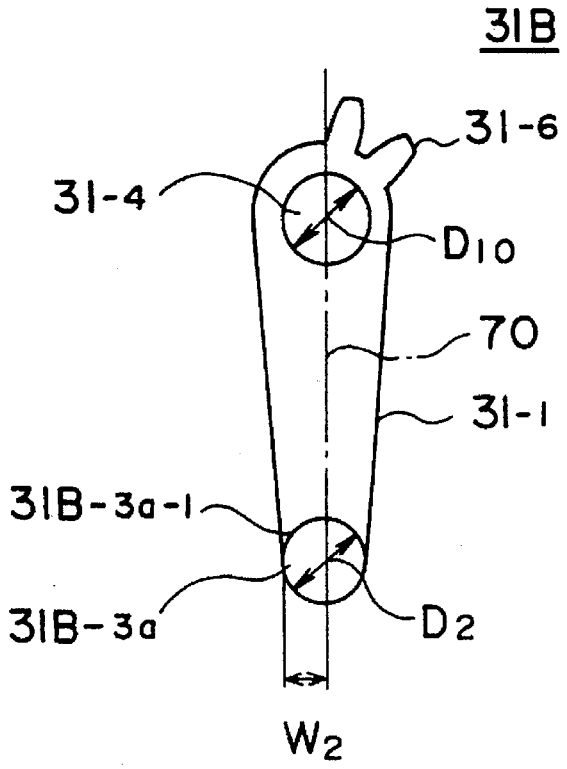

FIGS. 16A and 16B show the first link member 31B in detail.

Referring to FIGS. 16A and 16B, it will be noted that the pin $31_{-4}$, as well as the pin $31_{-5}$, has a diameter $D_{10}$ set slightly smaller than the foregoing diameter $D_1$ of the cutout $21B_{-15}$ but larger than the minimum width $W_1$ of the mouth part $21B_{-15b}$. As a result, the pin $31_{-4}$ is held stably in the cutout $21B_{-15a}$ and rotates freely therein. Further, it will be noted that the projection $31B_{-3a}$, as well as the projection $31B_{-3b}$, has a semi-circular shape having a diameter $D_2$ as defined by a surface $31B_{-3a-1}$. By forming the projections $31B_{-3a}$ and $31B_{-3b}$ as such, the projections $31B_{-3a}$ and $31B_{-3b}$ have a reduced thickness $W_2$, and the engagement with a corresponding guide such as the guide $25B_{-11}$ or $25B_{-12}$, is substantially facilitated as will be explained below.

Figure 17:
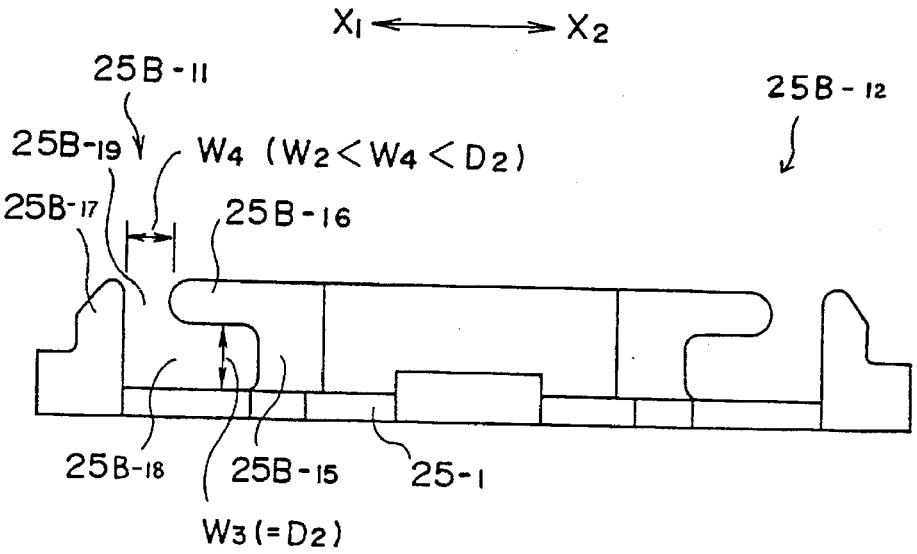
FIG. 17 is a diagram showing the construction of a base used in the keyswitch of the third embodiment.

FIG. 17 shows the construction or,the guides $25B_{-11}$ and $25B_{-12}$ in detail, wherein the description of the guide $25B_{-12}$ will be omitted as the construction of the guide $25B_{-12}$ is substantially identical with that of the guide $25B_{-11}$.

Referring to FIG. 17, the guide $25B_{-11}$ includes an L-shaped hook that in turn is formed of a base part $25B_{-15}$ extending in the upward direction from the base member $25_{-1}$ with a height $W_3$ set equal to the diameter $D_2$ of the projection $31B_{-3a-1}$, and a guide rail part $25B_{-16}$ continuing from the base member $25_{-1}$ and extending parallel to the base member $25_{-1}$ in the $X_1$-direction. Further, a pillar member $25B_{-17}$ is provided so as to extend in the upward direction from the base member $25_{-1}$, wherein the pillar member $25B_{-17}$ is provided such that a gap $25B_{-19}$ is formed between the pillar member $25B_{-17}$ and the guide rail part $25B_{-16}$ with a size of $W_4$ set smaller than the diameter $D_2$ but larger than the thickness $W_2$ of the projection $31B_{-3a}$. Thereby, the projection $31B_{-3a}$ is easily accommodated into the gap formed between the guide rail $25B_{-16}$ and the top surface of the base member $25_{-1}$ by properly setting the angle of the arm $31_{-1}$ of the link member 31B as explained below.

Figure 18:
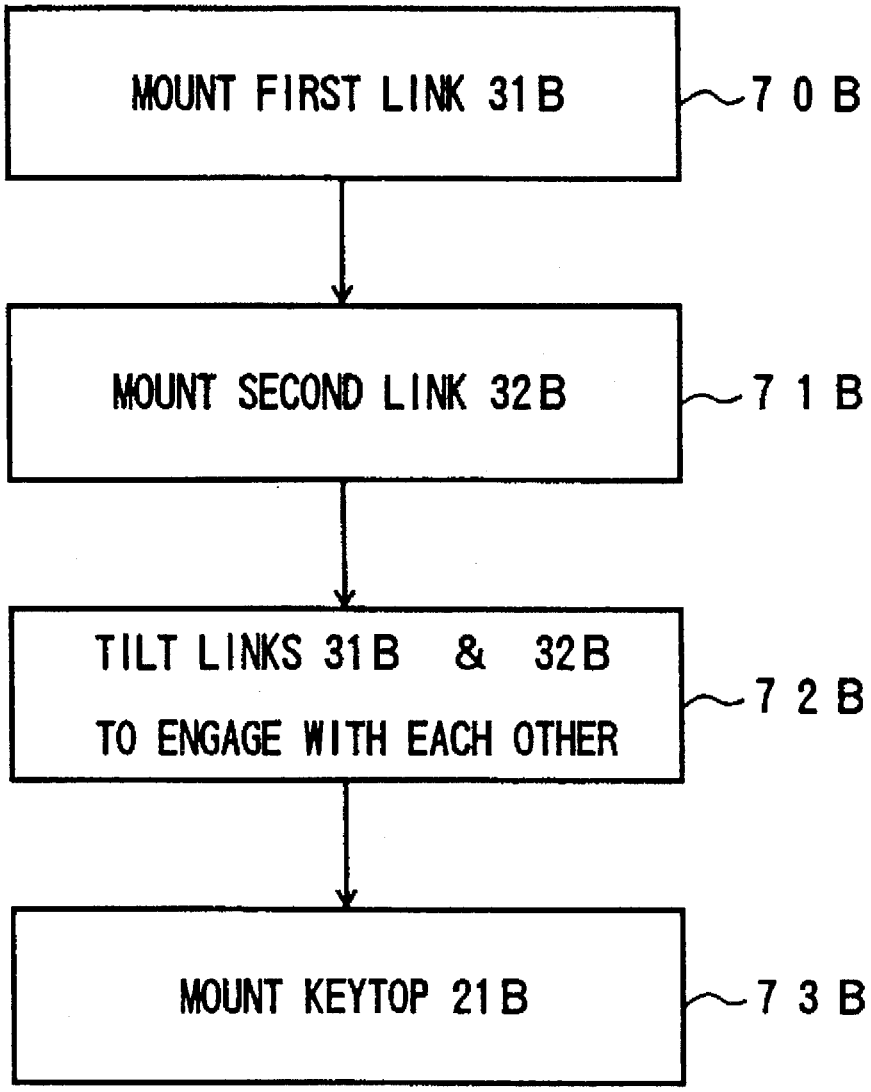
FIG. 18 is a flowchart showing the process of assembling the keyswitch of the present embodiment.

FIG. 18 shows the process of assembling the keyswitch 20B in the form of a flowchart.

Referring to FIG. 18, a step 70B is carried out first wherein the first link member 31B is mounted upon the base member $25_{-1}$ of the key housing 25B by engaging the projections $31B_{-3a}$ and $31B_{-3b}$ to the guide mechanisms $25B_{-11}$ and $25B_{-13}$ respectively. Next, in a step 71B, the second link member 32B is mounted upon the same base member $25_{-1}$ of the key housing 25B by engaging the projections $32B_{-3a}$ and $32B_{-3b}$ (not shown) respectively to the guide mechanisms $25B_{-12}$ and $25B_{-14}$. Further, in a step 72B, the link members 31B and 32B are tilted such that the toothed part $31_{-6}$ of the link member 31B and the toothed part $32_{-6}$ of the link member 32B engage with each other. Simultaneously, the toothed part $31_{-7}$ of the link member 31B and the toothed part $32_{-7}$ of the link member 32B engage with each other. Finally, in a step 73B, the keytop 21B is mounted upon the link members 31B and 32B thus engaged. Thereby, the link members 31B and 32B form together the link mechanism 27B as indicated in FIG. 13C.

Figure 19A:
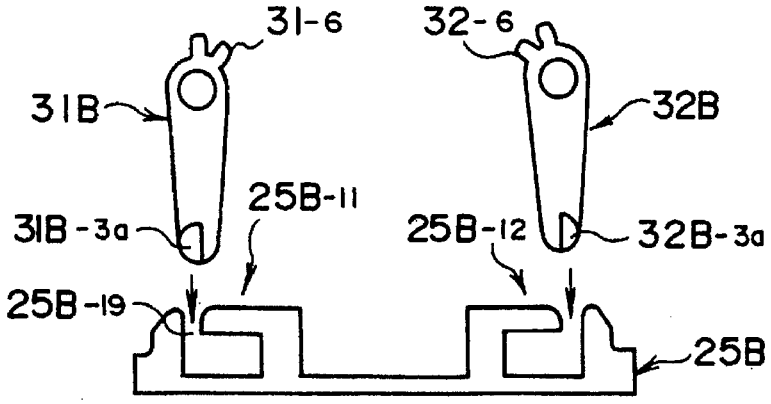
FIGS. 19A–19D are diagrams showing the process of assembling the keyswitch of the present embodiment.

FIG. 19A shows the step 70B of FIG. 18 in detail.

Figure 20A:
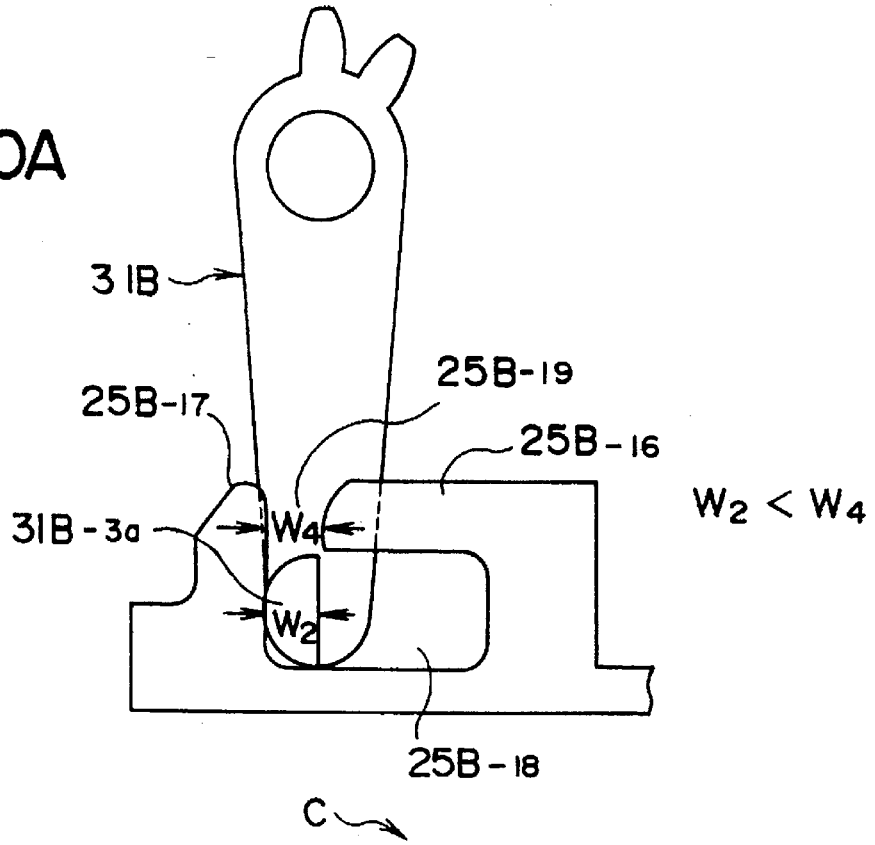
FIGS. 20A and 20B are diagrams showing a process of assembling link members of the keyswitch of the present invention.

Referring to FIG. 19A, the link members 31B and 32B are engaged with the guide mechanisms $25B_{-11}$ and $25B_{-12}$ by inserting the projection $31B_{-3a}$ into the guide mechanism $25B_{-11}$ through the gap $25B_{-19}$. Similarly, the projection $31B_{-3b}$ engages with the guide mechanism $25B_{-13}$. Thereby, the link member 31B is held vertically to the base member $25_{-1}$ of the key housing 25B, and semi-circular projection $31B_{-3a}$, having the thickness $W_2$, easily passes the gap $25B_{-19}$ of which size is set to $W_4$. Similarly, the link member 31B is engaged with the guide mechanism $25B_{-12}$ in the step 71B in the vertical state as indicated in FIG. 19A. See the enlarged diagram of FIG. 20A.

Figure 19B:
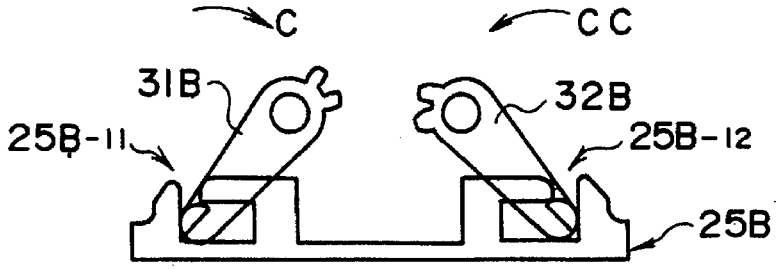

Next, in the step 72B, the link members 31B and 32B are tilted with each other respectively in the clockwise direction and in the counter-clockwise direction as indicated in FIG. 19B. As a result of the tilting of the arm 31B in the clockwise direction, it will be noted that the semi-circular projection $31B_{-3a}$ is positively caught by the guide rail part $25B_{-16}$ and the pillar member $25B_{-17}$ forming the guide mechanism $25B_{-11}$ as indicated in FIG. 20B. By tilting the link members 31B and 32B further, the toothed parts $31_{-6}$ and $32_{-6}$ mesh with each other as indicated in FIG. 19C.

Figure 19C:
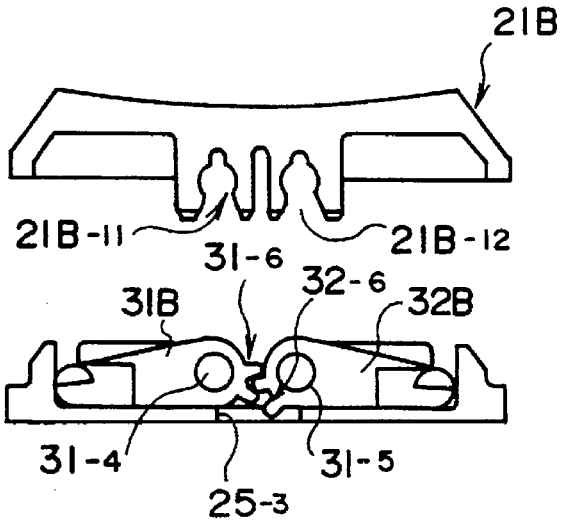
Figure 19D:
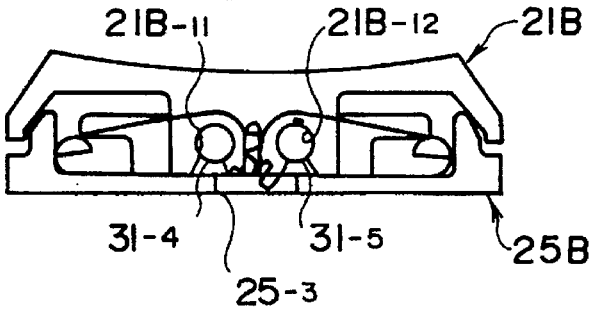
Figure 20B:
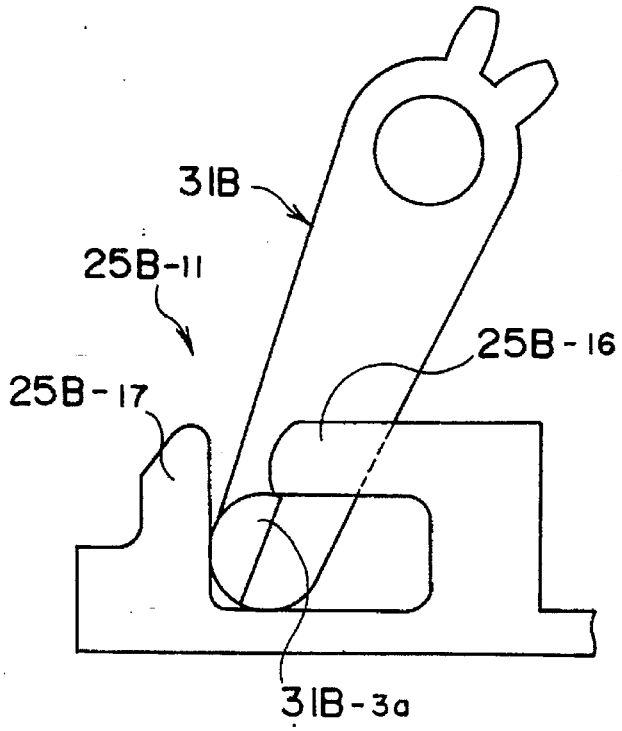

In the state of FIGS. 19C and 19D, it should be noted that the toothed parts $31_{-6}$ and $32_{-6}$ are accommodated in the elongated groove $25_{-3}$ formed on the top surface of the base member $25_{-1}$. Thereby, the height of the keyswitch 21B is minimized.

Further, by urging the keytop 21B in the downward direction in this state, the keytop 21B is successfully snapped upon the link members 31B and 32B as indicated in FIG. 19D.

Figure 21A:
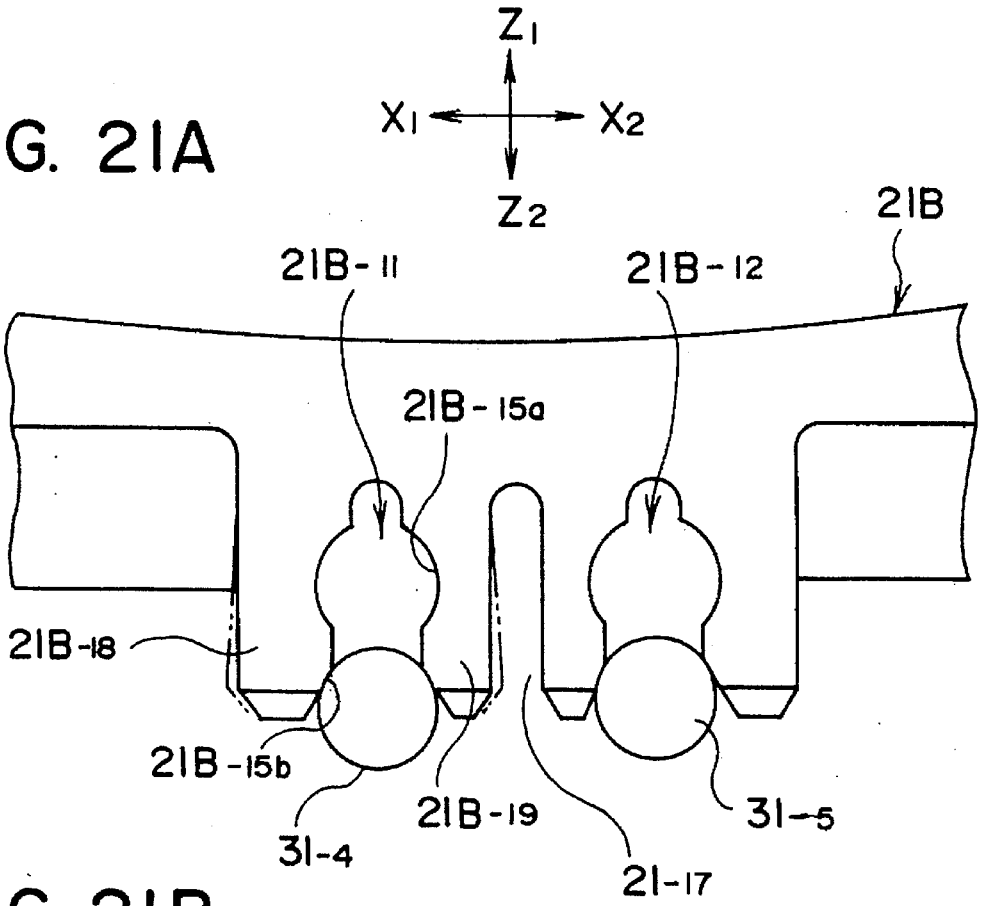
FIGS. 21A and 21B are diagrams showing the engagement of the link members when assembling the keyswitch of the present invention.
Figure 21B:
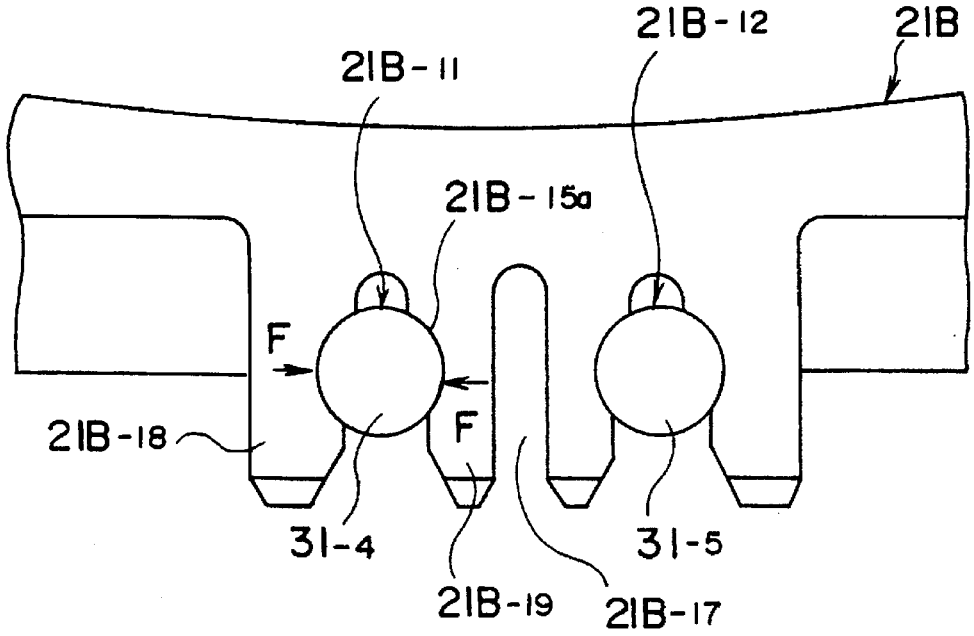

FIGS. 21A and 21B show the snap-on attachment of the keytop 21B upon the link members 31B and 32B.

Referring to FIGS. 21A and 21B, it will be noted that the pin $31_{-4}$ urges the mouth part $21B_{-15a}$ of the cutout $21B_{-15}$ and causes an elastic deformation in the fingers $21B_{-18}$ and $21B_{-19}$ as indicated in FIG. 21A. Although not illustrated, a similar elastic deformation is induced in the fingers defining the cutout $21B_{-12}$. Thereby, the deformation of the fingers is facilitated by forming the intervening cutout $21B_{-17}$.

By further urging the keytop 21B in the $Z_2$-direction, the pin $31_{-4}$, as well as the pin $31_{-5}$, cause a snap-fitting into the circular cutout $21B_{-15a}$ of the cutout $21B_{-15}$ or into the corresponding circular cutout of the cutout $21B_{-16}$, and the link members 31B and 32B are thus mounted upon the keytop 21B. Thereby, it will be noted that the link members 31B and 32B form together a link mechanism 27.

As already noted with reference to FIGS. 12A and 12B as well as with reference to FIGS. 13A–13C, the bridging parts $31_{-3}$ and $32_{-3}$ slide in the $X_1$- and $X_2$-directions upon actuation of the keytop 21B. Thereby, the keyswitch 20B has a preferable feature of reduced height similarly to the case of the keyswitch 20 described previously. Further, the keyswitch 20B has a preferable feature of immune to dusts. Furthermore, it will be noted that the assembling of the keyswitch 20B can be achieved by merely snap-fitting the link members 31B and 32B on the key housing 25 and further by snap-fitting the keytop 21B thereon, without using a tool.

Figure 22:
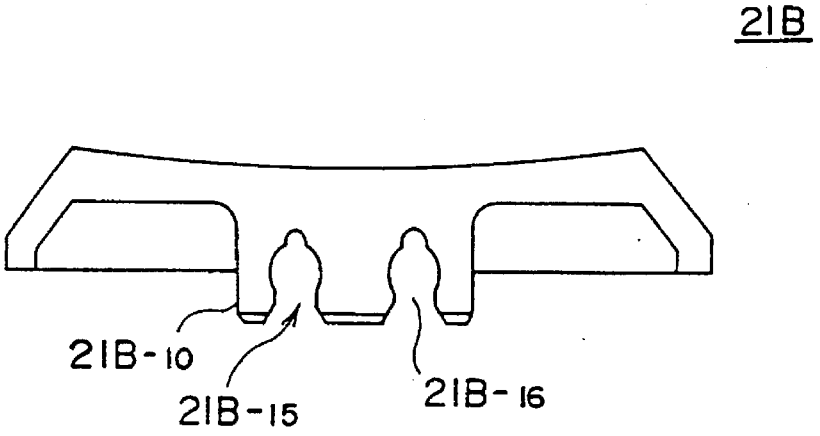
FIG. 22 is a diagram showing a deformation of the part of the keytop of the keyswitch of the present embodiment when assembling the keyswitch.

It will be noted that in the construction of the keytop 21B, one may eliminate the intervening cutout $21B_{-17}$ as indicated in FIG. 22.

Figure 23:
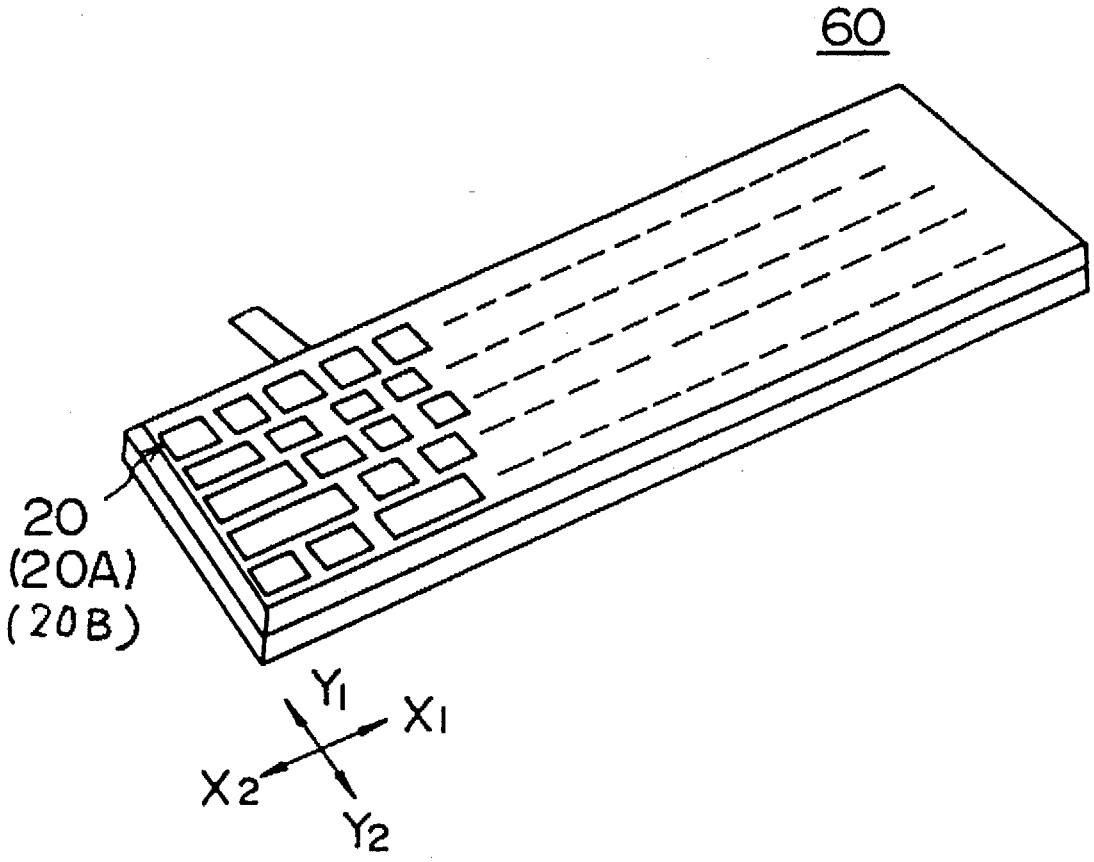
FIG. 23 is a diagram showing a keyboard that uses the keyswitch of the present invention.

FIG. 23 shows the construction of a keyboard 60 that uses the keyswitch described previously.

Referring to FIG. 23, it will be noted that the keyboard 60 includes a number of keyswitches arranged two-dimensionally, wherein each of the keyswitches may have a construction of the keyswitch 20, 20A or 20B. As explained before, each keytop moves vertically while maintaining a horizontal state as it is actuated, and a reliable typing operation is guaranteed. As the keyswitches have a reduced overall height, the keyboard 60 is suitable for use in compact computers such as laptops and palm-tops. Further, the keyboard 60 has an advantageous feature of immunity against dusts.

Further, the present invention is not limited to the embodiments described heretofore, but various variations and modifications may be made without departing from the scope of the invention.

What is claimed is:

1. A keyswitch, comprising:

a keytop having a keytop surface adapted for being pressed down and a rear surface;

a base disposed below said keytop;

an actuator disposed between said keytop and said base, said actuator deforming elastically upon pressing down of said keytop, said actuator thereby exerting a force pushing said keytop upward upon an elastic deformation thereof;

a switch disposed so as to be actuated by said actuator, said switch changing a state thereof upon a deformation of said actuator, between a first, opened state and a second, closed state;

a link mechanism disposed between said base and said keytop, said link mechanism including first and second link members each having a first end slidably engaging said rear surface of said keytop and a second, opposite end pivoted movably to said base at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in opposite directions about said first and second pivot axes;

said transmission part including a first gear provided at said second end of said first link member so as to be rotatable about said first pivot axis and a second gear provided at said second end of said second link member so as to be rotatable about said second pivot axis, said first and second gears meshing with each other such that said first and second link members move in opposite directions; and said rear surface of said keytop forming a guide surface for guiding therealong said first end of said first and second link members.

2. A keyswitch as claimed in claim 1, wherein said first gear is provided for a limited angle about said first pivot axis, and said second gear is provided for a limited angle about said second pivot axis.

3. A keyswitch as claimed in claim 2, wherein said limited angle of said first gear is 90 degrees or less, and wherein said limited angle of said second gear is 90 degrees or less, each of said first and second link members swinging for an angle of 45 degrees or less about respective first and second pivot axes.

4. A keyswitch as claimed in claim 1, wherein said base is formed with a depression on a surface thereof so as to accommodate said first and second gears therein upon movement of said first and second link members in a direction to lift up said keytop.

5. A keyswitch as claimed in claim 1, wherein said keytop is formed with a depression on said rear surface so as to accommodate said first and second gears therein upon movement of said keytop to a fully pressed down state.

6. A keyswitch, comprising:

a keytop having a keytop surface adapted for being pressed down and a rear surface;

a base disposed below said keytop;

an actuator disposed between said keytop and said base, said actuator deforming elastically upon pressing down of said keytop, said actuator thereby exerting a force pushing said keytop upward upon an elastic deformation thereof;

a switch disposed so as to be actuated by said actuator, said switch changing a state thereof upon a deformation of said actuator, between a first, opened state and a second, closed state;

a link mechanism disposed between said base and said keytop, said link mechanism including first and second link members each having a first end slidably engaging said rear surface of said keytop and a second, opposite end pivoted movably to said base at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in opposite directions about said first and second pivot axes;

each of said first and second link members having a U-shaped form, including a pair of arms extending parallel with each other, each of said arms carrying a gear at a first end thereof, and a bridging part connecting respective second ends of said arms with each other, said bridging part forming a slide engagement with said rear surface of said keytop; and said rear surface of said keytop forming a guide surface for guiding therealong said first end of said first and second link members.

7. A keyswitch, comprising:

a keytop having a keytop surface adapted for being pressed down;

a base disposed below said keytop;

an actuator disposed between said keytop and said base, said actuator deforming elastically upon pressing down of said keytop, said actuator thereby exerting a force that pushes said keytop upward upon an elastic deformation thereof;

a switch disposed so as to be actuated by said actuator, said switch changing a state thereof upon deformation of said actuator between a first, opened state and a second, closed state;

a link mechanism disposed between said base and said keytop, said link mechanism including first and second link members each having a first end slidably engaging with a principal surface of said base and a second, opposite end pivoted to said keytop at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in mutually opposite directions about said first and second pivot axes;

said transmission part including a first gear provided at said second end of said first link member so as to be rotatable about said first pivot axis and a second gear provided at said second end of said second link member so as to be rotatable about said second pivot axis, said first and second gears meshing with each other such that said first and second link members move in opposite directions; and said principal surface of said base forming a guide surface for guiding there along said first end of said first and second link members.

8. A keyswitch as claimed in claim 7, wherein said first gear is provided for a limited angle about said first pivot axis, and said second gear is provided for a limited angle about said second pivot axis.

9. A keyswitch as claimed in claim 8, wherein said limited angle of said first gear is 90 degrees or less, and wherein said limited angle of said second gear is 90 degrees or less, each of said first and second link members swinging for an angle of 45 degrees or less about respective first and second pivot axes.

10. A keyswitch as claimed in claim 7, wherein said base is formed with a depression on a surface thereof so as to accommodate said first and second gears therein upon movement of said first and second link members to a fully pressed down state.

11. A keyswitch as claimed in claim 10, wherein said base carries, on said principal surface, first and second guide rails for respectively holding first and second sliders provided on said first and second link members at respective first ends thereof, between said guide rail and said principal surface, such that said first slider slides along said first guide rail and such that said second slider slides along said second guide rail, said first and second sliders sliding in mutually opposite directions.

12. A keyswitch as claimed in claim 11, wherein said first guide rail includes a first stopper part at a first end thereof for restricting a further movement of said first link member in a direction for lifting up said keytop, said second guide rail includes a second stopper part at a first end thereof for restricting a further movement of said second link member in a direction for lifting up said keytop.

13. A keyswitch as claimed in claim 12, wherein said base carries, on said principal surface, a first stopper member so as to face a second end of said first guide rail for restricting a further movement of said first link member in a direction for lowering said keytop, said keytop further carries, on said rear surface, a second stopper member so as to face a second end of said second guide rail for restricting a further movement of said second link member in a direction for lowering said keytop.

14. A keyswitch as claimed in claim 13, wherein said first stopper member is separated from said second end of said first guide rail by a first gap having a size smaller than a diameter of a first slider provided at said first end of said first link member for slide engagement with said principal surface of said base, and wherein said second stopper member is separated from said second end of said second guide rail by a second gap having a size smaller than a diameter of a second slider provided at said first end of said second link member for slide engagement with said principal surface of said base, each of said first and second sliders having a semi-circular cross section such that said first and second sliders pass through said first and second gaps respectively upon setting said first and second link members to respective predetermined angles.

15. A keyswitch, comprising:

a keytop having a keytop surface adapted for being pressed down;

a base disposed below said keytop;

an actuator disposed between said keytop and said base, said actuator deforming elastically upon pressing down of said keytop, said actuator thereby exerting a force that pushes said keytop upward upon an elastic deformation thereof;

a switch disposed so as to be actuated by said actuator, said switch changing a state thereof upon deformation of said actuator between a first, opened state and a second, closed state;

a link mechanism disposed between said base and said keytop, said link mechanism including first and second link members each having a first end slidably engaging with a principal surface of said base and a second, opposite end pivoted to said keytop at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in mutually opposite directions about said first and second pivot axes;

said keytop carrying, on a rear surface thereof, a bearing mechanism for bearing said pivot axes of said first and second link members, said bearing mechanism including first and second cutouts each defined by a pair of resilient fingers for holding said first and second pivot axes respectively, said first and second cutouts having a circular shape for snap-fitting with respective pivot axes; and said principal surface of said base forming a guide surface for guiding there along said first end of said first and second link members.

16. A keyswitch, comprising:

a keytop having a keytop surface adapted for being pressed down;

a base disposed below said keytop;

an actuator disposed between said keytop and said base, said actuator deforming elastically upon pressing down of said keytop, said actuator thereby exerting a force that pushes said keytop upward upon an elastic deformation thereof;

a switch disposed so as to be actuated by said actuator, said switch changing a state thereof upon deformation of said actuator between a first, opened state and a second, closed state;

a link mechanism disposed between said base and said keytop, said link mechanism including first and second link members each having a first end slidably engaging with a principal surface of said base and a second, opposite end pivoted to said keytop at respective, first and second pivot axes, said link mechanism thereby holding said keytop on said base in a state movable to and from said base, said link mechanism further restricting a movement of said keytop to and from said base;

said first and second link members being engaged with each other mechanically at a transmission part such that a pivoting movement of one of said first and second link members is transmitted to the other of said first and second link members at said transmission part and such that said first and second link members swing in mutually opposite directions about said first and second pivot axes;

each of said first and second link members having a U-shaped form, including a pair of arms extending parallel with each other, each of said arms carrying a gear at a first end thereof, and a bridging part connecting respective second ends of said arms with each other, aid bridging part forming a slide engagement with said rear surface of said keytop; and said principal surface of said base forming a guide surface for guiding there along said first end of said first and second link members.

* * * * *

UNITED STATES PATENT AND TRADEMARK OFFICE

CERTIFICATE OF CORRECTION

PATENT NO. : 5,657,860

DATED : Aug. 19, 1997

INVENTOR(S) : KOIKE et al.

It is certified that error appears in the above-identified patent and that said Letters Patent is hereby corrected as shown below:

Col. 2, line 19, change "is t" to --is to--.

Co. 6, line 42, change "include" to --includes--.

Col. 8, line 15, change "31." to --$31_{-3}$--.

Col. 9, line 11, change "angle e" to --angle Θ--;
line 56, change "of,the" to --of the--;
line 62, after "21" insert --,--.

Col. 10, line 10, change "is-exposed" to --is exposed--;
line 27, change "an includes" to --and includes--.

Col. 11, line 64, change "2B" to --27B--.

Col. 13, line 15, change "or,the" to --of the--.

Signed and Sealed this

Twenty-third Day of December, 1997

Bruce Lehman

*Attest:*

BRUCE LEHMAN

*Attesting Officer*

*Commissioner of Patents and Trademarks*